US011020307B2

(12) United States Patent
Murakami et al.

(10) Patent No.: US 11,020,307 B2
(45) Date of Patent: Jun. 1, 2021

(54) ASSIST SYSTEM, ASSIST METHOD, AND STORAGE MEDIUM

(71) Applicant: Panasonic Intellectual Property Management Co., Ltd., Osaka (JP)

(72) Inventors: Kenta Murakami, Osaka (JP); Stephen John, Nara (JP); Mayumi Komatsu, Kyoto (JP); Jun Ozawa, Nara (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 739 days.

(21) Appl. No.: 15/695,003

(22) Filed: Sep. 5, 2017

(65) Prior Publication Data

US 2018/0092793 A1 Apr. 5, 2018

(30) Foreign Application Priority Data

Sep. 30, 2016 (JP) ..... JP2016-193112

(51) Int. Cl.
*A61H 3/00* (2006.01)
*A61H 1/02* (2006.01)

(52) U.S. Cl.
CPC ..... *A61H 1/0262* (2013.01); *A61H 3/00* (2013.01); *A61H 2201/0192* (2013.01); *A61H 2201/1223* (2013.01); *A61H 2201/149* (2013.01); *A61H 2201/165* (2013.01); *A61H 2201/5007* (2013.01); *A61H 2201/5038* (2013.01); *A61H 2201/5079* (2013.01); *A61H 2201/5084* (2013.01); *A61H 2201/5097* (2013.01); *A61H 2205/088* (2013.01); *A61H 2205/102* (2013.01)

(58) Field of Classification Search
CPC ..... A61H 1/0262; A61H 2201/16; A61H 2201/165; A61H 3/00; A61H 2003/007
See application file for complete search history.

(56) References Cited

U.S. PATENT DOCUMENTS 5,865,770 A * 2/1999 Schectman ..... A61F 5/0102 601/23
9,254,216 B2 * 2/2016 Limonadi ..... A61F 5/013
10,231,859 B1 * 3/2019 Thorne ..... A61F 5/0102
2002/0057203 A1 * 5/2002 Borders ..... A61H 9/0078 340/573.1

(Continued)

FOREIGN PATENT DOCUMENTS

JP 2014-133121 7/2014

*Primary Examiner* — Justine R Yu
*Assistant Examiner* — Christopher E Miller
(74) *Attorney, Agent, or Firm* — Wenderoth, Lind & Ponack, L.L.P.

(57) ABSTRACT

An assist system includes a fist belt worn on an upper body part of a user, a second belt worn on a knee of the user, a wire, a motor coupled with a first end of the wire and disposed on the first or second belt, a drive controller that controls drive of the motor, a gyro sensor that is disposed on the second belt and that measures an angular velocity about a direction perpendicular to the direction of the wire, and a controller. When the angular velocity is greater than or equal to a first threshold with a first tension being applied to the wire using the motor, the controller outputs first information. A second end of the wire is coupled with the second belt when the motor is disposed on the first belt but coupled with the first belt when the motor is disposed on the second belt.

15 Claims, 23 Drawing Sheets

(56) References Cited

U.S. PATENT DOCUMENTS

2006/0211956 A1* 9/2006 Sankai ..... A61B 5/04888 601/5
2009/0024062 A1* 1/2009 Einarsson ..... A61F 5/01 600/595
2009/0118651 A1* 5/2009 Rousso ..... A61H 11/02 601/134
2010/0160834 A1* 6/2010 Fong ..... A61B 5/1122 600/595
2011/0205067 A1* 8/2011 Konishi ..... A61H 1/024 340/573.1
2012/0029399 A1* 2/2012 Sankai ..... A61B 5/1121 601/40
2012/0165704 A1* 6/2012 Kang ..... A61H 1/0237 600/595
2013/0324894 A1* 12/2013 Herken ..... A61H 31/005 601/41
2014/0221894 A1* 8/2014 Nagasaka ..... A61H 3/00 602/23
2014/0296761 A1* 10/2014 Yamamoto ..... A61H 1/0244 602/23
2015/0173993 A1* 6/2015 Walsh ..... B25J 9/0006 414/4
2015/0216756 A1* 8/2015 Yamamoto ..... A61H 1/02 601/134
2015/0374573 A1* 12/2015 Horst ..... A61H 3/00 602/16
2016/0022440 A1* 1/2016 Ha ..... A61F 2/68 623/24
2016/0107309 A1* 4/2016 Walsh ..... A61H 3/00 248/550
2016/0193101 A1* 7/2016 Pu ..... A61F 2/70 623/24
2016/0213548 A1* 7/2016 John ..... A61H 1/0288
2016/0235615 A1* 8/2016 Yamamoto ..... A61H 3/00
2017/0027801 A1* 2/2017 Choi ..... A61H 1/0244
2017/0027802 A1* 2/2017 Jang ..... A61H 3/00
2017/0049658 A1* 2/2017 Kim ..... A61H 1/0244
2017/0202724 A1* 7/2017 De Rossi ..... A61H 3/00
2017/0340270 A1* 11/2017 Ganesh ..... A61B 5/165
2017/0360645 A1* 12/2017 Sodeyama ..... B25J 13/088
2018/0177667 A1* 6/2018 Uemura ..... B25J 9/0006

* cited by examiner

ASSIST SYSTEM, ASSIST METHOD, AND STORAGE MEDIUM

BACKGROUND

1. Technical Field

The present disclosure relates to an assist system, an assist method, and a storage medium, for assisting a movement of a human.

2. Description of the Related Art

Japanese Unexamined Patent Application Publication No. 2014-133121 discloses an assist tool capable of detecting a posture of a user using a sensor or the like and judging a fastening state of a corset varying depending on the posture of the user thereby allowing it to adjust the clamping force.

SUMMARY

However, in the conventional technique disclosed in Japanese Unexamined Patent Application Publication No. 2014-133121, it is difficult to prevent a belt from shifting from its correct position when the belt is not fastened tightly.

One non-limiting and exemplary embodiment provides an assist system that assists a movement of a person using a wire and that is capable of effectively detecting looseness or the like of a belt of the assist system.

In one general aspect, the techniques disclosed here feature an assist system including a first belt to be worn on an upper body of a user, a second belt to be worn on a knee of the user, a wire having a first end and a second end, a motor coupled with the first end, the motor being disposed on the first belt or the second belt, the second end being coupled with the second belt when the motor is disposed on the first belt, the second end being coupled with the first belt when the motor is disposed on the second belt, a drive controller that controls driving of the motor, a gyro sensor that is disposed on the second belt and that measures a magnitude of an angular velocity about a direction perpendicular to a longitudinal direction of the wire, and, a controller that outputs first information when a first condition is satisfied, the first condition including a condition that the magnitude is greater than or equal to a first threshold value when a first tension is applied to the wire by using the motor.

According to the present disclosure, it is possible to effectively detect a looseness of a belt or the like of an assist system.

It should be noted that general or specific embodiments may be implemented as an apparatus, a system, a method, an integrated circuit, a computer program, a computer-readable storage medium, or any selective combination thereof. The computer-readable storage medium may be a non-transitory storage medium such as a CD-ROM (Compact Disc-Read Only Memory) or the like.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1B:
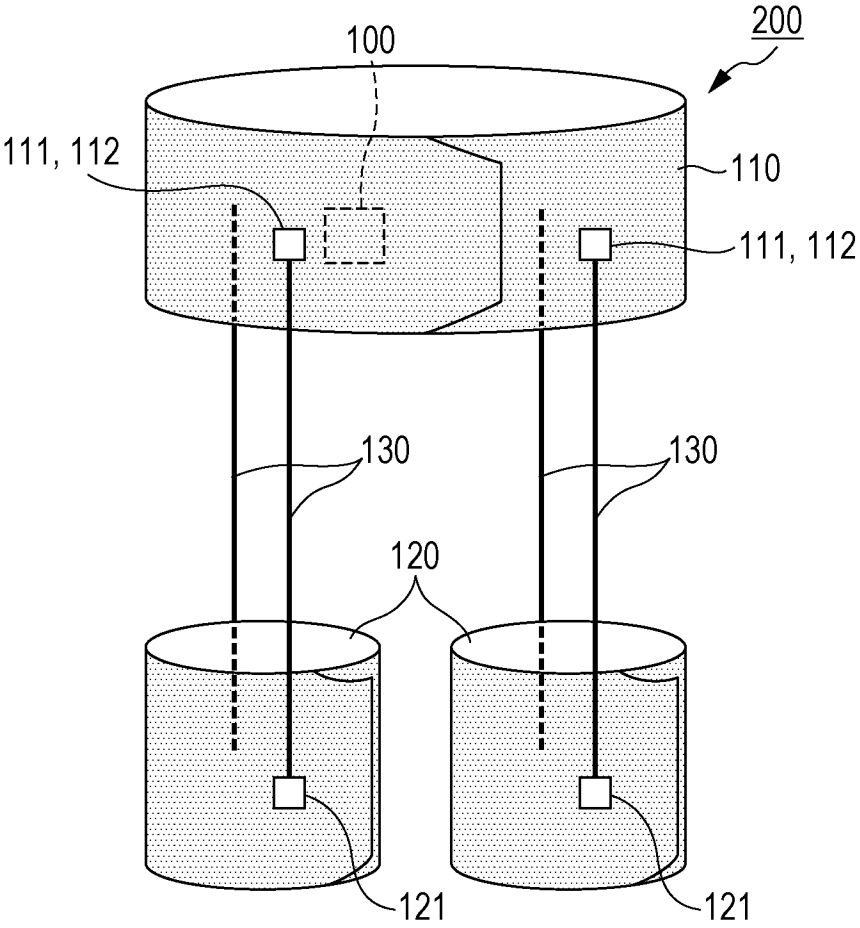
FIGS. 1A and 1B are schematic diagrams illustrating a manner in which an assist system according to an embodiment is used by a user.

Underlying Knowledge Forming Basis of the Present Disclosure

The present inventor has found a fact that a problem described below can occur in the assist tool described above in Section "2. Description of the Related Art".

In the assist tool disclosed in Japanese Unexamined Patent Application Publication No. 2014-133121, when the assist tool is worn, an actuator on the assist tool is driven to measure a clamping force of a belt thereby measuring a looseness of the belt. Based on a measured value, clamping is performed. However, in this assist tool, a shift of a belt position due to a looseness is not measured, and thus it is not possible to prevent the belt from being shifted from a correct position owing to the looseness of the belt.

In view of the above, the present disclosure provides improved techniques of effectively detecting looseness or the like of a belt in an assist system as described below.

In an embodiment of the present disclosure, an assist system includes a first belt to be worn on an upper body of a user, a second belt to be worn on each knee of the user, a wire having a first end and a second end, a motor coupled with the first end, the motor being disposed on the first belt or the second belt, the second end being coupled with the second belt when the motor is disposed on the first belt, the second end being coupled with the first belt when the motor is disposed on the second belt, a drive controller that controls driving of the motor, a gyro sensor that is disposed on the second belt and that measures a magnitude of an angular velocity about a direction perpendicular to a longitudinal direction of the wire, and a controller that outputs first information when a first condition is satisfied, the first condition including a condition that the magnitude is greater than or equal to a first threshold value when a first tension is applied to the wire by using the motor.

In this aspect, in the assist system that assists a person to move by using a wire, it is possible to effectively detect looseness or the like of the second belt in the assist system, and present a detection result to, for example, the user. This may prompt the user to refasten the belt securely such that the user is allowed to receive a more effective assisting force from the assist system. The first information may include information indicating that the second belt is a loose state. The first information may include information indicating whether the second belt is in a shifted state.

The assist system may further include an acceleration sensor, and the first condition may further include a condition that an acceleration measured by the acceleration sensor is smaller than or equal to a second threshold value.

Thus, in a situation in which a user is in a no-movement state, if the second belt is in a loose state or if the second belt is in a shifted state, it is possible to output information indicating such a state, which makes it possible to more effectively present information to the user as to the state.

The assist system may further include an acceleration sensor wherein when the acceleration measured by the acceleration sensor is smaller than or equal to the second threshold value, the drive controller may control the motor to apply the first tension to the wire.

Thus, in a situation in which a user is in a no-movement state, if the second belt is in a loose state or if the second belt is in a shifted state, it is possible to more effectively detect such a state.

In the assist system, the direction perpendicular to the longitudinal direction of the wire may be a direction that is a forward-backward direction as seen from the user and is perpendicular to the longitudinal direction of the wire, and the first information may include information indicating that the second belt is in a shifted state.

Thus, a user is allowed to refasten the second belt in response to the information so as to correct the wearing position of the second belt. Thus, when there is looseness of the second belt, it is possible to eliminate the looseness of the second belt.

The assist system may further include an accepter that accepts setting by a user, and a storage unit that stores the setting accepted by the accepter, wherein the controller may adjust the first threshold value depending on the setting stored in the storage unit and outputs, as the information, a result of judgement performed using the adjusted first threshold value.

According to this aspect, the first threshold value used in the judgment of the looseness or the shift of the second belt is adjusted depending on the setting performed by a user, and thus it is possible to output a result of judgment performed properly depending on the user's preference as to the looseness or the shift of the second belt.

Note that general or specific embodiments described above may be implemented as a method, an integrated circuit, a computer program, a computer-readable storage medium, or any selective combination thereof.

The assist system according to embodiments of the present disclosure is described in detail below with reference to drawings.

Note that each embodiment described below is for illustrating a specific example of an implementation of the present disclosure. In the following embodiments of the present disclosure, values, shapes, materials, constituent elements, locations of elements, manners of connecting elements, steps, the order of steps, and the like are described by way of example but not limitation. Among constituent elements described in the following embodiments, those constituent elements that are not described in independent claims indicating highest-level concepts of the present disclosure are optional.

Embodiments

In the following description of embodiments, it is assumed by way of example that when the upper-body belt unit and the knee belt unit of the assist system are worn on a user's body or when the user is in a no-movement state after the assist system is worn, the looseness of the knee belt unit is judged from a value output from an acceleration sensor and/or a gyrosensor of the assist system, and information is presented to the user as to a result of the judgment.

1.1 Configuration

An assist system 200 according to an embodiment is described below with reference to drawings.

Figure 1A:
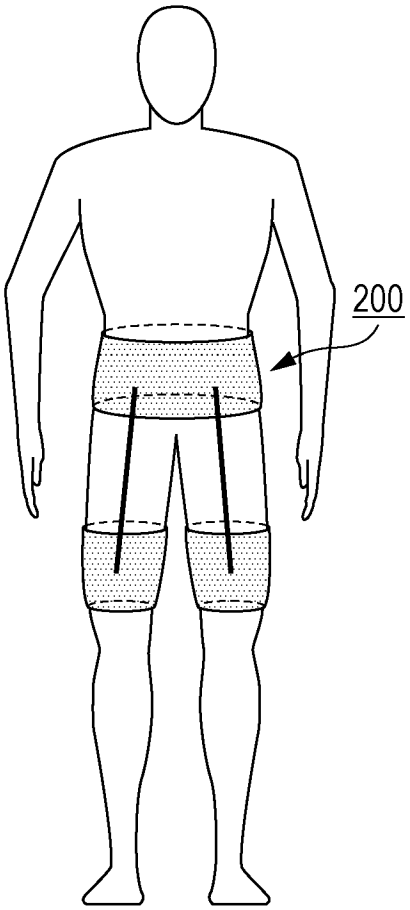
Figure 2:
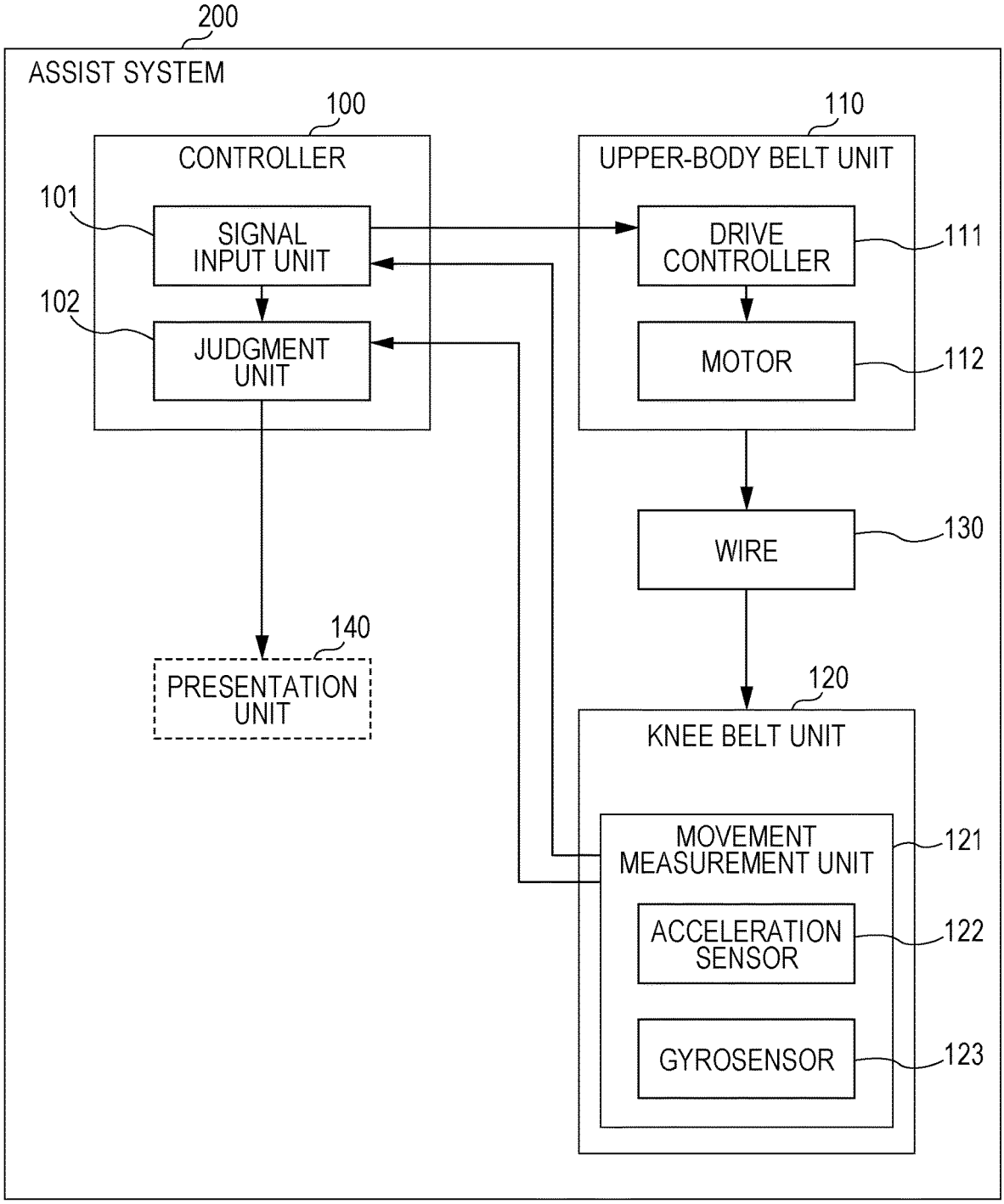
FIG. 2 is a block diagram illustrating a configuration of an assist system according to an embodiment.

FIGS. 1A and 1 B are schematic diagrams illustrating a manner in which an assist system according to an embodiment is used by a user, and FIG. 2 is a block diagram illustrating a configuration of the assist system according to the embodiment.

As illustrated in FIGS. 1A and 1 B and FIG. 2, the assist system 200 includes a controller 100, an upper-body belt unit 110 functioning as a first belt, one or more knee belt units 120 each functioning as a second belt, and one or more wires 130. Hereinafter, for simplify of explanation, a description "the knee belt unit 120" is used to describe either one of the knee belt units 120, and a description "the wire 130" is used to describe either one of the plurality of wires 130 unless otherwise stated. The assist system 200 may further include a presentation unit 140 that presents information as to a wearing state determined by the controller 100.

The controller 100 includes a signal input unit 101 and a judgment unit 102. The controller 100 is disposed, for example, on the upper-body belt unit 110. Alternatively, the controller 100 may be disposed on the knee belt unit 120.

The signal input unit 101 generates a calibration signal for use in detecting the looseness of the knee belt unit 120.

The judgment unit 102 judges the wearing state of the knee belt unit 120 of a user from a result of a measurement performed by a movement measurement unit 121 of the knee belt unit 120. More specifically, when a first tension is applied by a motor 112 to the wire 130, the judgment unit 102 determines whether an angular velocity measured by a gyrosensor 123 of the movement measurement unit 121 is greater than or equal to a first threshold value. In a case where it is determined that the angular velocity measured by the gyrosensor 123 is greater than or equal to the first threshold value, the judgment unit 102 outputs information indicating that the knee belt unit 120 is in a loose state or the knee belt unit 120 is in a shifted state. Note that the loose state refers to a state in which the knee belt unit 120 is not securely fastened to a user, and thus if a tension is applied from the wire 130 to the knee belt unit 120, the knee belt unit 120 may move toward a thigh of the user. The shifted state refers to a state in which the knee belt unit 120 is worn in a wrong position, that is, the position of the knee belt unit 120 is deviated in one rotational direction from a correct position on a thigh of a user, wherein the correct position is such a position where two wires 130 connected to one knee belt unit 120 are correctly aligned to each other at front and backs sides of the thigh.

The controller 100 may be realized, for example, using a processor and a memory such that the processor executes a particular program stored in the memory. Alternatively, the controller 100 may be realized using a dedicated circuit.

The upper-body belt unit 110 includes a drive controller 111 and a motor 112. The upper-body belt unit 110 is a wearing unit that is worn on an upper-body part of a user as shown in FIG. 1A. Examples of upper-body parts of a user are a waist, shoulders, and the like. In this system, when the wire is pulled, the upper-body belt unit is pulled downward vertically (toward the knee belt unit). When the wire is pulled in this way, if the upper-body belt unit is located, for example, on a waist, the belt is prevented by a pelvis from sliding. In a case where the upper-body belt unit is worn on shoulders of a user, the upper-body belt unit can be fixed on the shoulders by carrying the upper-body belt unit in a similar manner as when carrying a backpack.

For example, the upper-body belt unit 110 may be formed in a long band shape like a sash such that it is allowed to be worn around a waist of a user. The upper-body belt unit 110 may include a fastener such as a hook and loop fastener that allows it to be kept fastened around the waist. The upper-body belt unit 110 may be formed using, for example, an inelastic material such that the upper-body belt unit 110 is not easily deformed when a tension is applied in an assist operation.

The drive controller 111 controls the driving of the motor 112 according to the received signal. The motor 112 is coupled with the wire 130 such that under the control of the drive controller 111, the motor 112 pulls or loosens the wire 130. The motor 112 is fixed at a particular location on the upper-body belt unit 110.

The upper-body belt unit 110 may be formed in a barrel shape. In this case, the perimeter of the barrel is set to be longer than the perimeter of the waist of a user. To achieve this, the upper-body belt unit 110 may include an adjustment mechanism for adjusting the length of the upper-body belt unit 110 depending on the length of the waist of the user. For example, a hook and loop fastener may be used as the adjustment mechanism. The hook and loop fastener is provided such that a hook fastener part extending beyond an end of the belt and can be attached to a loop fastener part disposed on the opposite end of the belt.

The wire 130 connects between the upper-body belt unit 110 and the knee belt unit 120. More specifically, the wire 130 connects between the motor 112 and the knee belt unit 120. The wire 130 has a first end and a second end. The first end is connected to the motor 112. In a case where the motor 112 is disposed on the upper-body belt unit 110, the second end is connected to the knee belt unit 120. In a case where the motor 112 is disposed on the knee belt unit 120, the second end is connected to the upper-body belt unit 110.

The knee belt unit 120 includes a movement measurement unit 121. The knee belt unit 120 may be formed in the shape of, for example, a long band like the upper-body belt unit 110. The knee belt unit 120 is worn on a thigh or a part above a knee of a user. The knee belt unit 120 does not need to be worn on a hip joint. The thigh of a human has a feature that its cross-sectional size gradually increases from the knee to the hip. Therefore, when the knee belt unit 120 is worn around a thigh's part slightly above a knee and the knee belt unit 120 is fastened securely, significant sliding of the knee belt unit 120 does not occur when it is pulled by the wire and thus it is possible to provide an efficient assist to a user. For example, after the knee belt unit 120 is worn around a thigh of a user, the two ends of the knee belt unit 120 are attached together such that the knee belt unit 120 is kept in the worn state. The knee belt unit 120 may be formed using an inelastic material that is not easily deformed when a tension is applied to the knee belt unit 120 in an assisting operation. In the present embodiment, the assist system 200 includes two knee belt units 120 to be respectively worn around two legs on a user. Note that the assist system 200 may include only one knee belt unit 120. Note that in the following description, a description "the knee belt unit 120" is used to describe the only one knee belt unit 120 when there is only one knee belt unit 120, but when there are two knee belt units 120, it describes either one of the two knee belt units 120 unless otherwise stated.

The movement measurement unit 121 is disposed on the knee belt unit 120 and measures a movement of the knee belt unit 120. More specifically, two movement measurement units 121 are disposed on the two respective knee belt units 120. Each movement measurement unit 121 includes an acceleration sensor 122 that measures an acceleration of a corresponding one of the two knee belt units 120 in each of three different directions respectively along the X-axis, the Y-axis, and Z-axis. Each movement measurement unit 121 also includes a gyrosensor 123 that measures an angular velocity of a corresponding one of the two knee belt units 120 in each of rotational directions about the X-axis, the Y-axis, the Z-axis. Note that in the following description, the expression "the movement measurement unit 121" is used to describe either one of the two movement measurement units 121 unless otherwise stated. That is, the gyrosensor 123 is disposed on a front side of a corresponding one of the two knee belt units 120 and the gyrosensor 123 measures angular velocities in the respective rotational directions about the X-axis, the Y-axis, and the Z-axis where the X-axis is defined in the longitudinal direction of one of the two wires 130 that is connected to the front side of the knee belt unit 120. The movement measurement unit 121 transmits a measurement result to the judgment unit 102 of the controller 100. To align the X-axis of the acceleration sensor 122 so as to be coincident with the X-axis of the wire, an arrow mark indicating the X-axis of the acceleration sensor 122 may be formed on the acceleration sensor 122 of the movement measurement unit 121, and the movement measurement unit 121 may be positioned such that the direction of the arrow mark is coincident with the direction of the wire. The Y-axis and Z-axis are defined as follows. After the X-axis defined, a direction (in a right-left direction of a user) that is horizontal and perpendicular to the X-axis is defined as the Y-axis, and another direction (in a forward-backward direction of the user) that is vertical to the X-axis is defined as the Z-axis. The three respective axes of the gyrosensor 123 of the movement measurement unit 121 are defined in a similar manner to the X-axis, the Y-axis, and the Z-axis.

As described above, the upper-body belt unit 110 and the knee belt unit 120 are formed using an inelastic material, and thus in a case where the knee belt unit 120 is worn securely around a leg of a user with no looseness, it is possible to easily transfer an assisting force to the user and thus it is possible to achieve more efficient assist. Note that another movement measurement unit 121 may also be disposed on the upper-body belt unit 110 to measure a movement of the upper-body belt unit 110 thereby measuring a movement of a user.

The presentation unit 140 presents to a user a result of the judgement made by the judgment unit 102 of the controller 100. That is, the presentation unit 140 presents to a user information indicating whether the knee belt unit 120 is in a loose state or the knee belt unit 120 is in a shifted state.

Figure 3B:
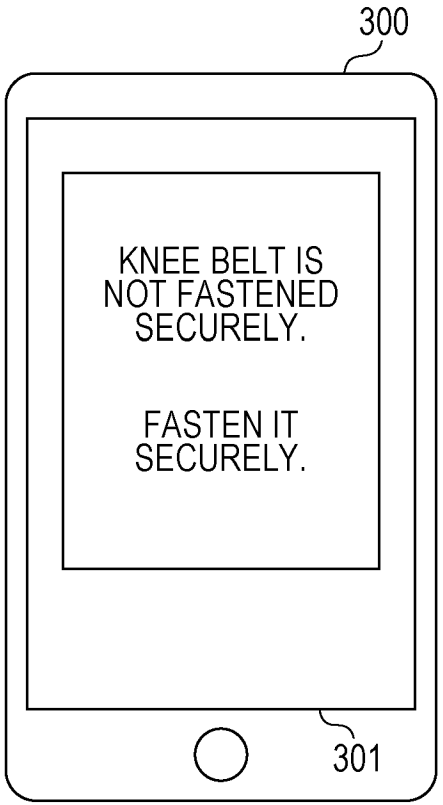
FIGS. 3A and 3B are diagrams each illustrating an example of a method of presenting information when a user uses an assist system.
Figure 3A:
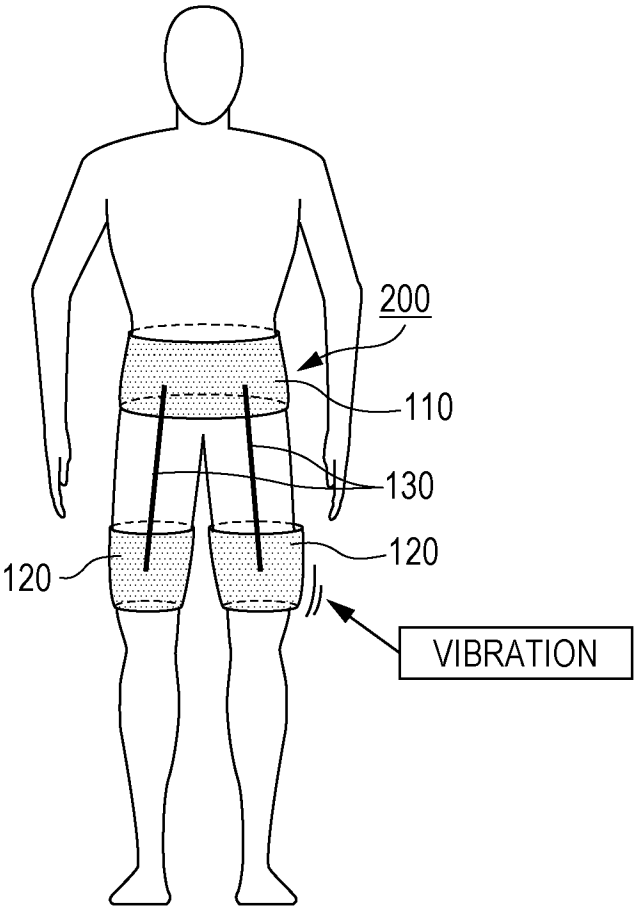

FIGS. 3A and 3B are diagrams each illustrating an example of a manner in which information is presented to a user using the assist system.

In a case where the knee belt unit 120 worn on a user is in a loose state, the presentation unit 140 presents, to the user, information indicating that the knee belt unit 120 is in the loose state. In a case where the knee belt unit 120 worn on a user is shifted from a correct wearing position, the presentation unit 140 presents, to the user, information indicating that the knee belt unit 120 is shifted from its correct position. For example, the presentation unit 140 may be realized by disposing a vibration actuator (not shown) on the knee belt unit 120 as shown in FIG. 3A such that when the knee belt unit 120 is in a loose state or/and when the knee belt unit 120 is shifted from its correct wearing position, the vibration actuator vibrates thereby notifying the user of the state. Alternatively, for example, the presentation unit 140 may be realized by disposing a vibration actuator on the upper-body belt unit 110 such that when the knee belt unit 120 is in a loose state or/and when the knee belt unit 120 is shifted from its correct wearing position, the vibration actuator vibrates thereby notifying the user of the state. Alternatively, when the knee belt unit 120 is in a loose state or/and when the knee belt unit 120 is shifted from its correct wearing position, the presentation unit 140 may transmit information indicating this state to a portable terminal 300 such as a smartphone or the like of the user such that an image or text information indicating the state is displayed on a display 301 of the portable terminal 300 as shown in FIG. 3B.

Figure 4:
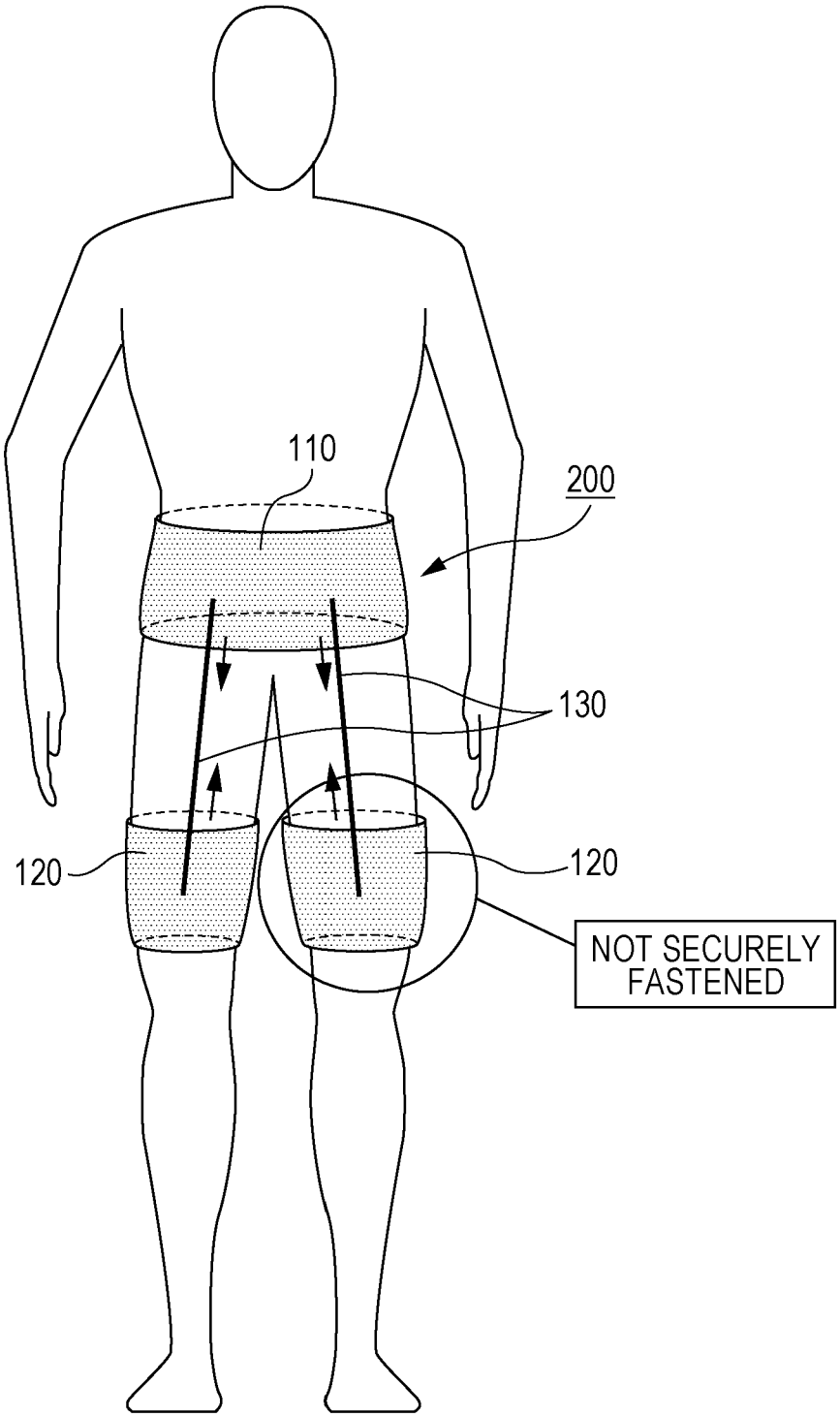
FIG. 4 is a diagram illustrating an example of a method of making a judgement of a looseness.

FIG. 4 is a diagram illustrating an example of a method of judging looseness.

The assist system 200 assists a user to move his/her two legs (for example, in walking) by pulling up the knee belt units 120 from the upper-body belt unit 110 via the wires 130. A total of four wires 130 are provided such that two are provided for a left leg and two for right leg of a user. One of each two wires is located on a front side and the other one is located on a back side of a leg. Four motors 112 are provided for the four respective wires 130. That is, the four motors 112 are disposed on the upper-body belt unit 110 at proper locations corresponding to the front and back sides of the two knee belt units 120. Thus, pulling forces can be applied, at four locations, to the user who wears the assist system 200. The magnitude of the pulling force applied at each of the four locations and the timing of applying the pulling force are controlled such that the movements of the two legs of the user are properly assisted. In the assisting operation, if either one of the knee belt units 120 is in a loose state, as shown in FIG. 4, then this knee belt unit 120 moves along the thigh of the user, and thus the assisting force applied via the wire 130 is not effectively transferred to the thigh of the user. In this situation, a change occurs in the acceleration of the knee belt unit 120 in the longitudinal direction of the wire 130 (that is, in the X-axis direction), and, furthermore, a large change occurs in angular velocity in rotational directions perpendicular to the direction of the wire (that is, angular velocity in rotational directions about the Y-axis and the Z-axis).

In the assist system 200 according to the present embodiment, a calibration signal is input in order to apply a first tension to the wire 130 thereby detecting, using the phenomenon described above, whether the assist system 200 is fastened securely on a user without looseness of the knee belt unit 120. The assist system 200 evaluates the accelerations and the angular velocities detected by the acceleration sensor 122 and the gyrosensor 123 disposed on the knee belt unit 120 thereby determining whether the knee belt unit 120 is in a loose state or not. The assist system 200 also evaluates the angular velocities detected by the gyrosensor 123 and determines whether the knee belt unit 120 is shifted from a correct wearing position or not.

As described above, the assist system 200 detects whether the knee belt unit 120 is in a loose state or not and/or whether the knee belt unit 120 is in a shifted state or not, and the assist system 200 outputs a detection result, and thus if the knee belt unit 120 has a looseness or a shift, a user can easily get aware of the looseness or the shift immediately after the user wears the assist system 200 or after some movement is performed wearing the assist system 200. Therefore, the user can properly re-fasten the knee belt unit 120 such that it becomes possible to receive a more effective assist from the assist system 200 in terms of the movements of the two legs of the user.

Next, elements in the functional block diagram shown in FIG. 2 are described in detail below.

1.1.1 Signal Input Unit

The signal input unit 101 is a unit that determines a signal for use in detecting whether the knee belt unit 120 is in a loose state or not when the assist system 200 is worn on a user and transmits the determined signal to the drive controller 111. More specifically, the signal input unit 101 determines the first tension to be applied to the wire 130 for pulling the knee belt unit 120, and then determines an input pattern for calibration based on the determined first tension, and finally transmits a calibration signal of the determined input pattern to the drive controller 111. More specifically, the signal input unit 101 generates the calibration signal by which to drive the motor 112 to apply the first tension to the wire 130, and outputs the generated calibration signal to the drive controller 111 described later. The signal input unit 101 may calculate the rotation angle by which the motor 112 is to be rotated to achieve the determined first tension, and then determine the input pattern for the calibration based on the calculated rotation angle, and finally transmit the calibration signal of the determined input pattern to the drive controller 111.

Figure 5:
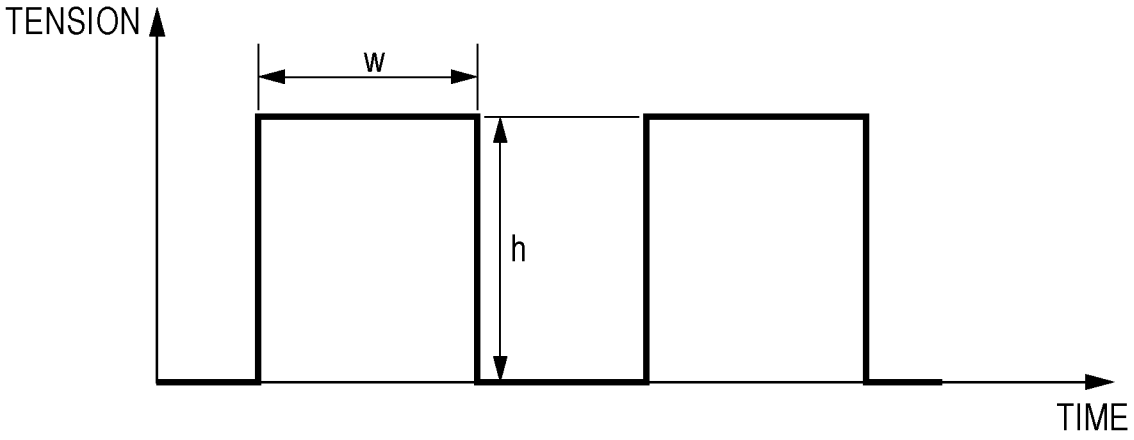
FIG. 5 is a graph showing a calibration signal for a case where an input pattern is a pulse wave.
Figure 6:
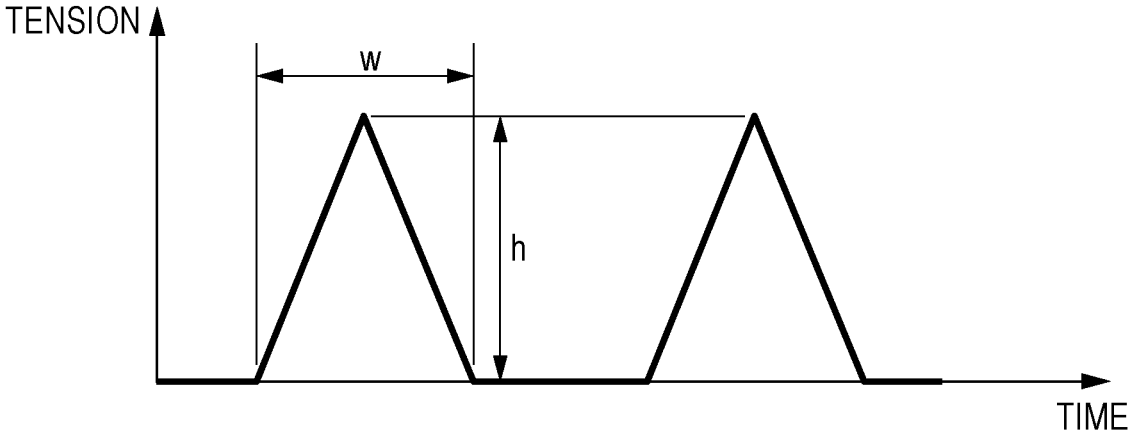
FIG. 6 is a graph showing a calibration signal for a case where an input pattern is a triangular wave.

FIG. 5 and FIG. 6 are graphs each illustrating an example of a calibration signal. FIG. 5 is a graph illustrating a calibration signal for a case where the input pattern is a pulse wave. FIG. 6 is a graph illustrating a calibration signal for a case where the input pattern is a triangular wave. As shown in FIG. 5 and FIG. 6, the input pattern of the calibration signal may be a pulse wave or a triangular wave.

In FIG. 5 and FIG. 6, w denotes a signal width, and h denotes an input tension (the magnitude of the first tension).

First, an explanation is given for the case where the pulse wave is used as the input pattern of the calibration signal. If the input tension h is too small, then even when the knee belt unit 120 is in a loose state, the knee belt unit 120 is not slid sufficiently enough to correctly detect whether the knee belt unit 120 is in a loose state or in a shifted state. On the other hand, if the input tension h is too large, then even when the knee belt unit 120 is fastened around the thigh of a user tightly enough to sufficiently assist the movement of the two legs of the user, there is a possibility that the knee belt unit 120 is slid too much. Therefore, the magnitude of the input tension h may be determined within a predetermined range (for example, 50 to 400 N) in which the input tension h is applied when the movements of the two legs of the user are assisted. In a case where the knee belt unit 120 is shifted when the input tension within the predetermined range is applied to the wire 130, the assisting force is not well transferred to the thigh of the user. In this case, the controller 100 determines that the knee belt unit 120 is in a loose state or the knee belt unit 120 is in a shifted state, and thus the controller 100 determines that it is necessary for the user to properly re-fasten the knee belt unit 120.

Note that the pulse wave is an input pattern having a steep rising edge and a steep falling edge, and the rising time and the falling time are small enough compared with the signal width w. Therefore, when the signal width w is greater than a particular threshold value, for example, 0.1 seconds, it is possible to drive the knee belt unit 120 much enough to correctly determine whether the knee belt unit 120 is in a loose state or a shifted state. However, to quickly detect the looseness or the shift of the knee belt unit 120, it is desirable that the signal width w be as small as allowed. Therefore, in the present embodiment, in the case where the pulse wave is used as the input pattern for the calibration signal, the signal width w may be set in range, for example, from 0.1 to 1.0 sec.

In a case where a triangular wave is used for the input signal, the input tension h may be set within a range substantially equal to a range (for example, from 50 to 400 N) in which the input tension is applied in the operation of assisting the movements of the two legs of the user as in the case of the pulse wave. The influence of the signal width w on the knee belt unit 120 is different depending on whether the signal width w is large or small. For example, in a case where the signal width w is as small as, for example, 0.2 sec, the input tension rises up to h and falls down to original value of 0 in a short period, and thus the waveform is similar to that of a step input like the pulse wave, which causes the knee belt unit 120 to operate in a similar manner to the case where the pulse wave is used. On the other hand, in a case where the signal width w is as large as, for example, greater than 1.0 sec, the tension of the wire increases gradually and linearly and then again decreases. Thus, it is possible to control the motor 112 so as to precisely provide the change in the tension of the wire described above. That is, in a case where the knee belt unit 120 is in a loose state, when a calibration signal with a signal width w greater than 1.0 sec is input to the drive controller 111, the tension provided by the wire 130 increases slowly, and thus the knee belt unit 120 is pulled gradually by the wire 130. As a result, the knee belt unit 120 shifts from its original position. After the calibration signal reaches a vertex of the triangular wave, the input tension h starts to decrease. In this case, therefore, the knee belt unit 120 has a less probability of returning to its original position during the falling down period of the triangular wave than in the case where the tension is applied by a sharp waveform.

That is, in the case where the calibration signal used has an input pattern of a triangular wave and has a signal width w as large as, for example, 1.0 sec or larger, the judgment unit 102 of the controller 100 calculates displacement values (displacements in the X-axis direction, the Y-axis direction, and the Z-axis direction, and amounts of rotation about the X-axis, the Y-axis, and the Z-axis) of the knee belt unit 120 from the accelerations and the angular velocities detected by the movement measurement unit 121 disposed on the knee belt unit 120. That is, the judgment unit 102 calculates the shift of the knee belt unit 120 from its original position. If the calculated shift is greater than a predetermined threshold value (for example, 1 cm), the judgment unit 102 may judge that the knee belt unit 120 is in a loose state.

In the present embodiment, by way of example, the calibration signal has a predetermined one input pattern, and the looseness and/or the shift of the knee belt unit 120 is judged using the calibration signal. However, the calibration signal is not limited to this example. For example, two calibration signals respectively having the two input patterns described above may be input, and the looseness and/or the shift of the knee belt unit 120 may be judged from a combination of measured results provided by the movement measurement unit 121. For example, when a calibration signal having an input pattern of a pulse wave is input 4 times to the drive controller 111, if it is determined that the knee belt unit 120 is in a loose state two out of four times, it is difficult to correctly determine whether the knee belt unit 120 is in a loose state or a shifted state. In such a case, the controller 100 may further input a calibration signal having an input pattern of a triangular wave and having a large signal width w. A displacement amount of the knee belt unit 120 that occurs in response to the input calibration signal is calculated from values measured by the movement measurement unit 121, and if the displacement amount is greater than a predetermined threshold value (for example, 1 cm), it may be determined that the knee belt unit 120 is in a loose state.

Figure 7:
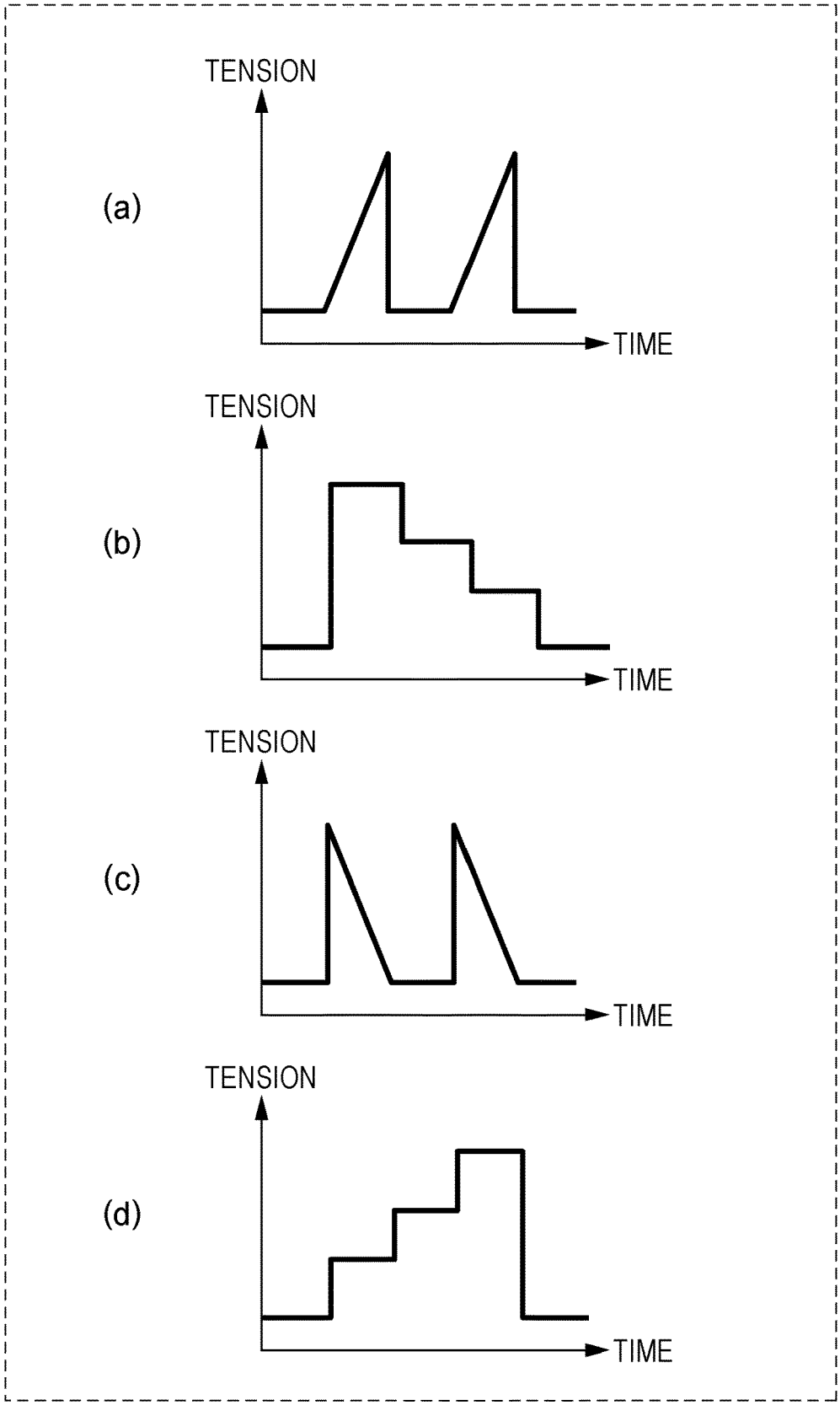
FIG. 7 is a graph showing a calibration signal for a case where another type of input pattern is given.

Calibration signals having input patterns other than those shown in FIG. 5 and FIG. 6, such as those shown in FIGS. 7(*a*) to 7(*d*), may be used as calibration signals. More specifically, FIG. 7(*a*) is a graph showing an example of a calibration signal having an input pattern that causes the tension to increase linearly and then fall down steeply. FIG. 7(*b*) is a graph showing an example of a calibration signal having an input pattern that decreases in a stairstep fashion. FIG. 7(*c*) is a graph showing an example of a calibration signal having an input pattern that causes the tension to increase steeply and then decrease linearly. FIG. 7(*d*) is a graph showing an example of a calibration signal having an input pattern that causes the tension to increase in a stairstep fashion. A calibration signal having one of input patterns shown in FIGS. 7(*a*) to 7(*d*) may be input, and the looseness and/or the shift of the knee belt unit 120 may be judged based on a movement of the knee belt unit 120 that occurs in response to a change in tension.

For example, in a case where the calibration signal shown in FIG. 7(*a*) is used, an abrupt reduction in tension causes the knee belt unit 120 to quickly return to its original position and inertia causes the knee belt unit 120 to further move beyond the original position. In a case where the calibration signal shown in FIG. 7(*b*) or FIG. 7(*c*) is used, a result is similar to that achieved when the triangular wave with large w shown in FIG. 6 is used. In a case where the calibration signal shown in FIG. 7(*d*) is used, the shift of the knee belt unit 120 increases gradually, and thus the final shift of the knee belt unit 120 from its original position becomes great. By using various types of input patterns for the calibration signal in the judgement of the looseness and/or the shift knee belt unit 120, it becomes possible to achieve improved accuracy in the judgement of the looseness and/or the shift knee belt unit 120.

1.1.2 Drive Controller

The drive controller 111 is a unit that is disposed on the upper-body belt unit 110 and drives the motor 112 in accordance with a signal received from the signal input unit 101. More specifically, the drive controller 111 calculates a necessary number of revolutions of the motor 112 from an input tension indicated by the signal received from the signal input unit, and drives the motor 112 to rotate by the calculated necessary number of revolutions. In a case where the signal received from the signal input unit 101 indicates the necessary number of revolutions, the drive controller 111 may drive the motor 112 to rotate by the number of revolutions indicated by this signal.

The drive controller 111 may receive, from the controller, information indicating that the acceleration measured by the acceleration sensor 122 is smaller than or equal to a second threshold value. In this case, when the drive controller 111 receives this information, the drive controller 111 may drive the motor 112 to apply a first tension to the wire 130 for performing a calibration.

1.1.3 Movement Measurement Unit

The movement measurement unit 121 is disposed on the knee belt unit 120 and measures a movement of the knee belt unit 120. The movement measurement unit 121 transmits a measurement result in terms of the measured movement as time-series data to the judgment unit 102. More specifically, the movement measurement unit 121 includes the acceleration sensor 122 and the gyrosensor 123, thereby measuring a movement of the knee belt unit 120 that occurs when the knee belt unit 120 is pulled by the motor 112 via the wire 130. In a case where the knee belt unit 120 is not fastened securely around a thigh, the amount of displacement of the knee belt unit 120 due to the pulling by the wire 130 is greater than in the case where the knee belt unit 120 is fastened securely on the thigh (hereinafter this state will be referred to simply as a tight state). In a case where the wearing position of the knee belt unit 120 is shifted from a correct position, when the knee belt unit 120 is pulled by the wire 130, for example, a rotational force is applied to the knee belt unit 120. Note that a more detailed description will be given later as to which values of those acquired by the movement measurement unit 121 are used in the judgment of the wearing state.

The assist system 200 is basically used to assist a user to move, for example, to walk. To properly providing assisting, it is necessary to judge whether the knee belt unit 120 is in a loose state or not immediately after the assist system 200 is worn or after some movement is performed wearing the assist system 200. The timing of making the judgement of the looseness of the knee belt unit 120 is immediately after the assist system 200 is worn or after some movement is performed wearing the assist system 200. In any case, the assist system 200 needs to perform the judgment when the user is in a no-movement state. Therefore, based on measurement values provided from the acceleration sensor 122 and the gyrosensor 123, the movement measurement unit 121 may determine whether the user is in a no-movement state or not. If it is determined that the user is in a no-movement state, a start signal for starting the calibration may be transmitted to the signal input unit 101.

Figure 8:
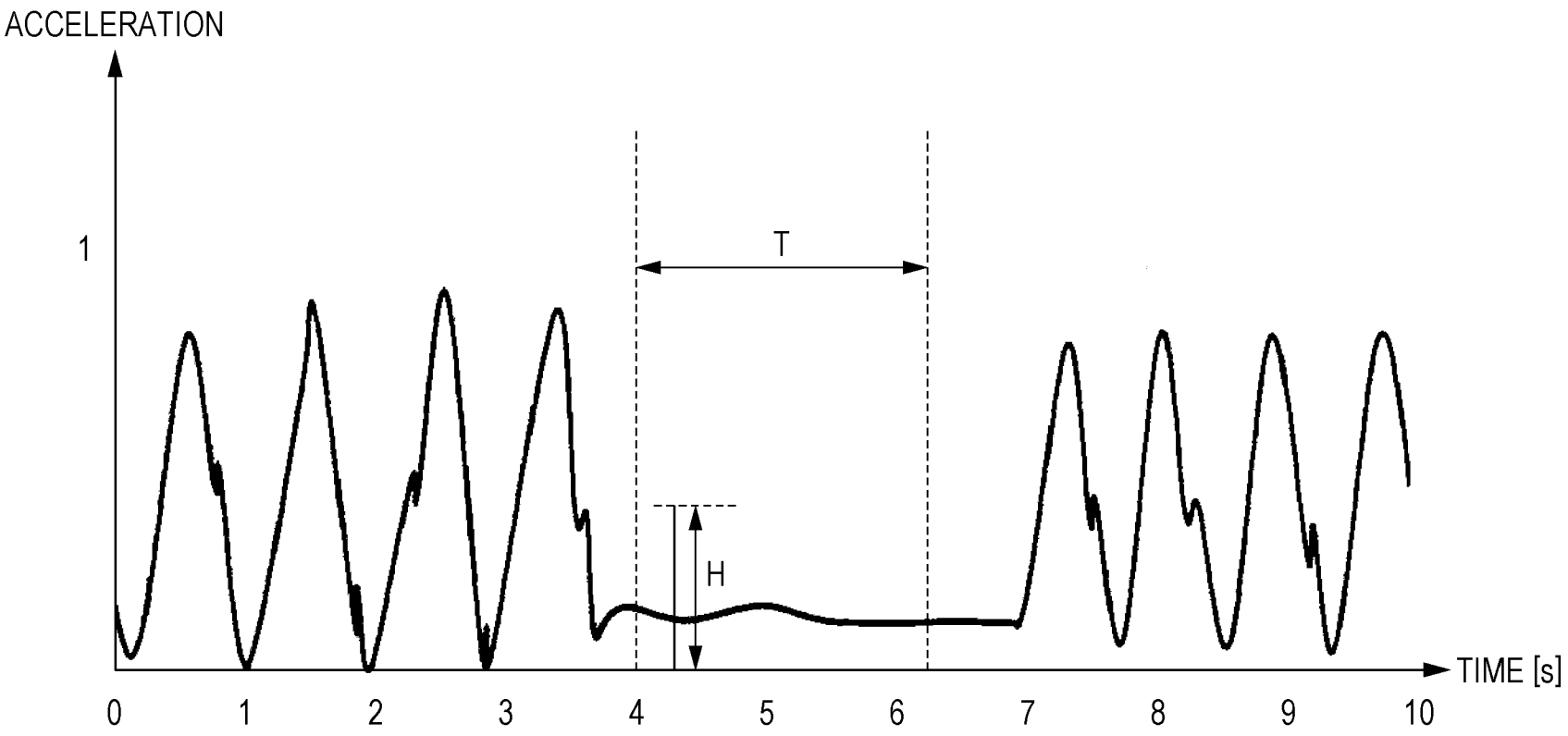
FIG. 8 is a diagram illustrating an example of determining timing of starting calibration.

FIG. 8 is a diagram illustrating an example of a process of determining the timing of starting a calibration. In a graph shown in FIG. 8, a horizontal axis represents time, and a vertical axis represents an acceleration which is a resultant value obtained by combining respective accelerations in the X-axis direction, the Y-axis direction and the Z-axis direction. In the example shown in FIG. 8, when a user stops, for example, at a traffic signal or the like during walking, accelerations are measured by the movement measurement unit 121 in the X-axis direction, the Y-axis direction, and the Z-axis direction, and a change in the resultant combined acceleration is shown. When the change in the resultant acceleration obtained by combining respective accelerations in the X-axis direction, the Y-axis direction, and the X-axis direction is measured, if the change is smaller than or equal to a second threshold value H (for example, 0.3 $m/s^2$) over a certain time period with a particular length (for example, 2 sec or longer) as with the case shown in FIG. 8, then the movement measurement unit 121 may determine that the user is in a no-movement state, and may transmit a start signal to the signal input unit 101. That is, the movement measurement unit 121 determines whether it is time to start a calibration by determining whether the acceleration measured by the acceleration sensor 122 disposed on the knee belt unit 120 is smaller than or equal to the second threshold value. If the resultant acceleration obtained by combining the respective accelerations in the X-axis direction, the Y-axis direction, and the Z-axis direction is smaller than or equal to the second threshold value, the movement measurement unit 121 transmits, to the signal input unit 101, a start signal indicating that the calibration is to be started.

In the example described above, the criterion for judging whether to start the calibration is, by way of example, that the time period T is 2 sec and the second threshold value H is 0.3 $m/s^2$ in terms of the resultant acceleration obtained by combining the respective accelerations in the X-axis direction, the Y-axis direction, and the Z-axis direction. However, the judgment criterion is not limited to this example. The time period T may be set to different values as long as it is allowed to detect whether a user is moving during walking or the like or the user in no-movement state. Therefore, for example, a walk cycle of a person is detected by the acceleration sensor 122, and the time period T may be set to be twice the one step period determined from the detected walk cycle. For example, in a case where the one step period of a user is 1.5 sec, the time period T may be set to 3 sec. The second threshold value H in terms of the resultant acceleration obtained by combining the respective accelerations in the X-axis direction, the Y-axis direction, and the Z-axis direction may also be determined based on a magnitude of change in acceleration of a user during walking. For example, the second threshold value H may be set to one-third the change in the resultant acceleration obtained by combining the respective accelerations in the X-axis direction, the Y-axis direction, and the Z-axis direction in walking.

In the example described above, the movement measurement unit 121 determines that the calibration is to be started when the resultant acceleration obtained by combining the respective accelerations in the X-axis direction is smaller than or equal to the second threshold value H. However, the manner of starting the calibration is not limited to this example. For example, a start button for starting the calibration may be provided in the assist system 200, and the calibration may be started when the start button is pressed by a user. The start button may be disposed, for example, on the controller 100 or the knee belt unit 120 such that it is allowed for a user to press the start button, for example, when the user stops at a traffic signal or the like thereby checking the looseness of the knee belt. In a case where the movement measurement unit 121 makes the judgment described above, the movement measurement unit 121 may be realized using the acceleration sensor 122, the gyrosensor 123, and a dedicated circuit or a processor for performing the judgment, and the like. In a case where the judgement described above is not performed, the movement measurement unit 121 may be realized using the acceleration sensor 122 and the gyrosensor 123.

1.1.4 Judgment Unit

The judgment unit 102 is a unit that determines whether the knee belt unit 120 worn on a user is in a loose state or not based on a measurement result provided by the movement measurement unit 121. The judgment unit 102 also functions as a unit that detect a shift of the waring position of the knee belt unit 120 worn on a user. More specifically, when the judgment unit 102 receives the calibration start signal from the signal input unit 101, the operation mode goes into the judgment mode in which the judgement as to the looseness and/or the shift of the knee belt unit 120 is performed. After the operation mode goes into the judgment mode, the judgment unit 102 receives values in terms of accelerations and/or angular velocities from the movement measurement unit 121, and judges whether the knee belt unit 120 is in a loose state and whether the knee belt unit 120 is in a shifted state.

Next, a method of judging the looseness and/or the shift of the knee belt by the judgment unit 102 is described below.

In a case when the knee belt unit 120 is pulled from the upper-body belt unit 110, the judgment unit 102 first performs the judgement of the looseness of the knee belt unit 120 based on the magnitude of the change in the acceleration in the direction in which the wire 130 is pulled.

Figure 9:
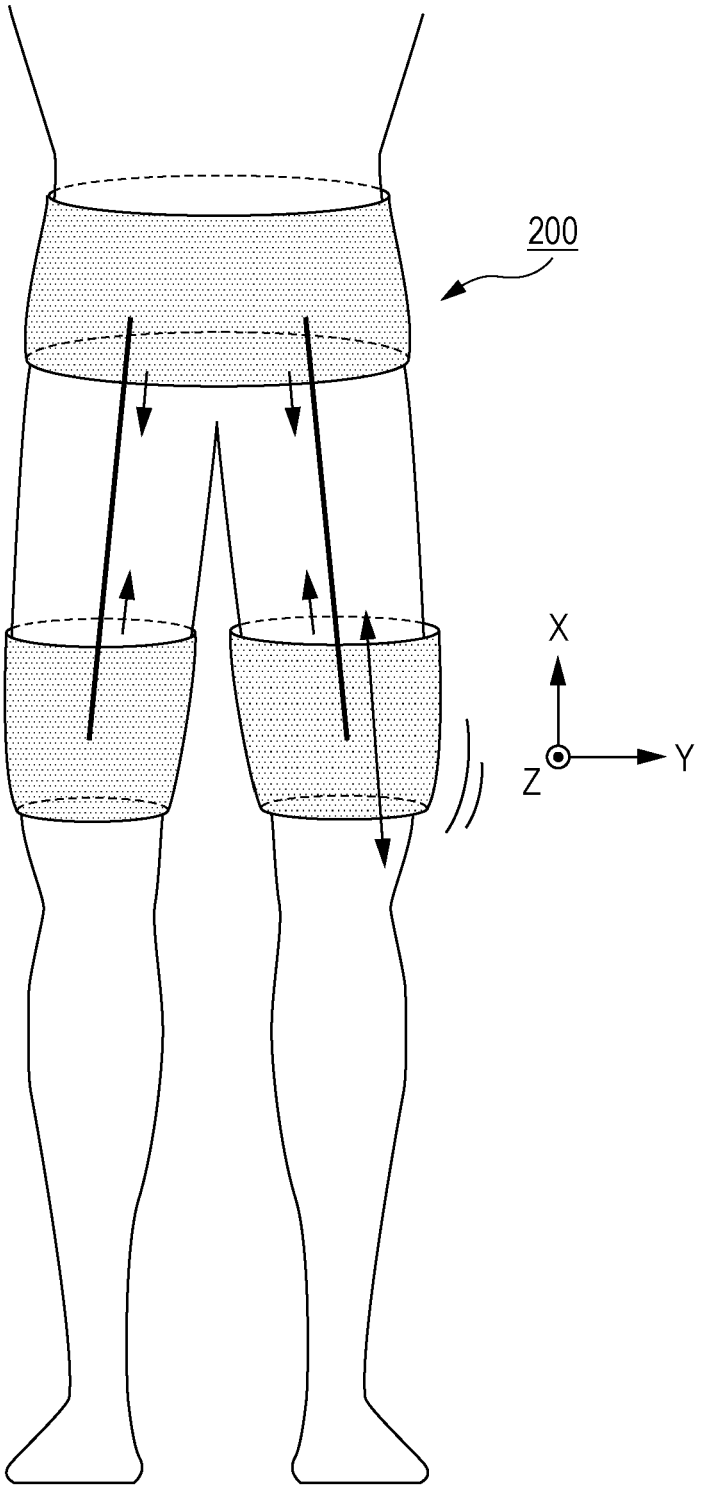
FIG. 9 is a diagram illustrating a state in which a knee belt is shifted in a direction in which a wire is pulled.

FIG. 9 illustrates a state in which the knee belt has a shift in a direction in which the knee belt is pulled by the wire.

In the following description of the present embodiment, as shown in FIG. 9, it is assumed that the X-axis is defined in an upward-downward direction of a user, the Y-axis is defined in a right-left direction of the user, and the Z-axis is defined in a forward-backward direction of the user where position directions thereof are defined in an upward direction, leftward direction, and forward direction, respectively.

In the assist system 200, the wire 130 connected between the upper-body belt unit 110 and the knee belt unit 120 extends in the X-axis direction. Therefore, when the knee belt unit 120 is in a loose state, if the knee belt unit 120 is pulled by the wire 130, then, in the knee belt unit 120, first, a change occurs in the acceleration in the X-axis direction. An example of this situation is illustrated in FIG. 10.

Figure 10:
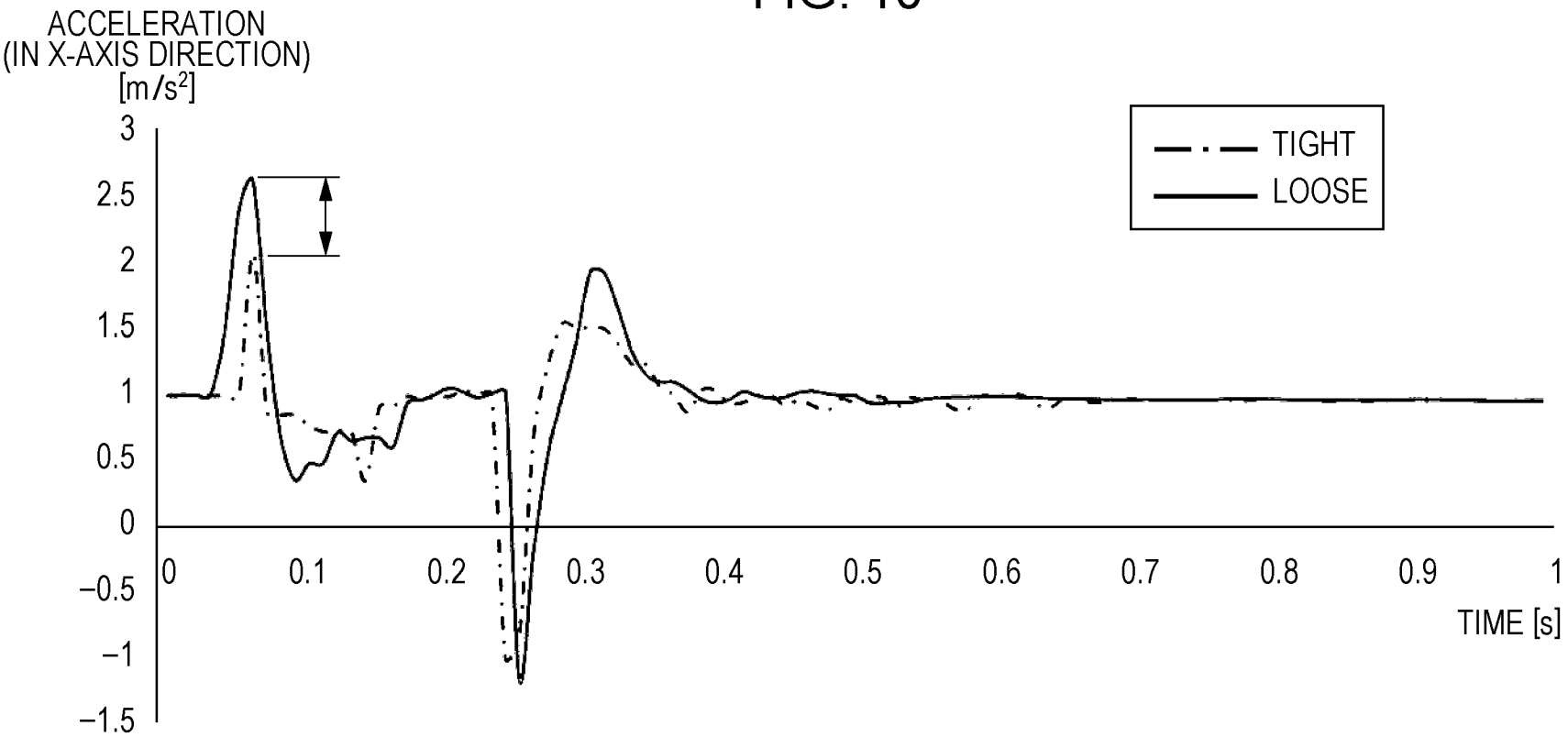
FIG. 10 is a graph showing a change in acceleration at a knee belt unit in a direction along an X-axis when a first tension is applied to a wire by inputting a pulse-wave calibration signal.

FIG. 10 is a graph indicating a change in acceleration of the knee belt unit 120 in the X-axis direction that occurs when a calibration signal of a pulse wave with w=0.2 sec and h=100 N is input to the drive controller 111 thereby applying the first tension to the wire 130. In the graph shown in FIG. 10, a horizontal axis represents time, and a vertical axis represents the acceleration in the X-axis direction. In this graph, a dash-dot line (Tight) represents an acceleration change in a state in which the knee belt unit 120 is fastened tightly, and a solid line (Loose) represents an acceleration change in a state in which the knee belt unit 120 is loose. As shown in FIG. 10, a greater change in the acceleration in the X-axis direction occurs in the case where the knee belt unit 120 is in the loose state than in the case where the knee belt unit 120 is fastened tightly. Therefore, when the calibration signal of the pulse wave corresponding to the first tension (for example, h=100 N) is input, if an acceleration in the X-axis direction greater than or equal to the particular threshold value (for example, 2.5 $m/s^2$) occurs, then the judgment unit 102 may determine that the knee belt unit 120 is in a loose state.

Figure 11:
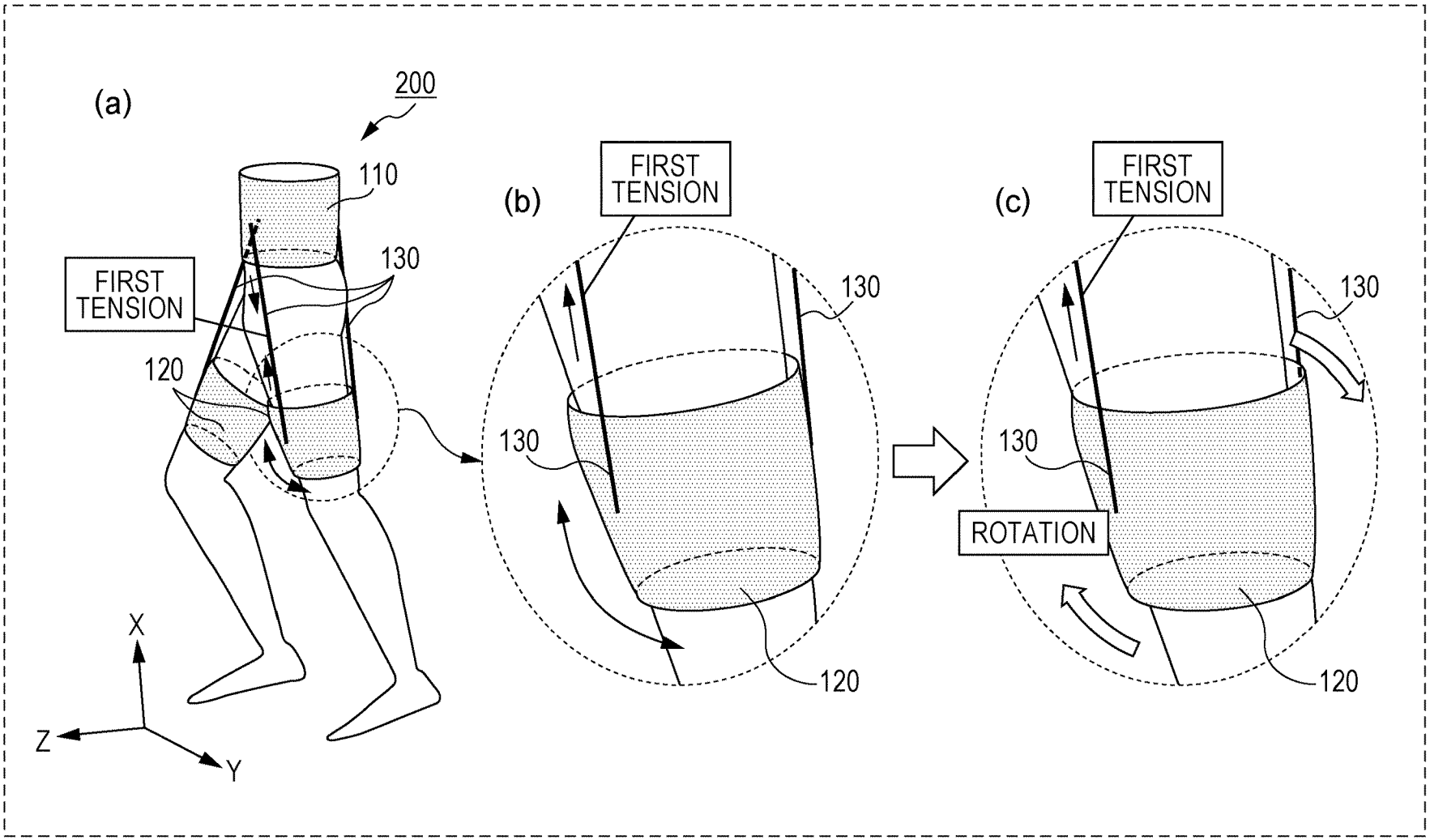
FIG. 11 is a diagram illustrating a rotational movement of a knee belt unit about a Y-axis direction when a first tension is applied to a wire.

The judgment unit 102 may determine whether the knee belt unit 120 is in a loose state or not based on information provided from the movement measurement unit 121, in particular, using information indicating a change in angular velocity about the Y-axis. FIG. 11 is a diagram illustrating a rotational movement of the knee belt unit about the Y-axis that occurs when the first tension is applied to the wire. More specifically, FIG. 11(*a*) illustrates the assist system 200 seen from the Y-axis direction in a state in which the first tension is applied to the wire 130. FIG. 11(*b*) and FIG. 11(*c*) each illustrate an enlarged view of the knee belt unit 120 shown in FIG. 11(*a*). Each of these figures shows a manner in which the knee belt unit 120 moves when the first tension is applied to the wire 130.

As shown in FIG. 11(*a*) and FIG. 11(*b*), when the wire 130 is pulled in a situation in which the knee belt unit 120 is in a loose state, the knee belt unit 120 moves not only in the longitudinal direction of the wire 130 (in the X-axis direction) but a rotational movement about the Y-axis also occurs as shown in FIG. 11(*c*). In particular, in the case where wires 130 are connected to the knee belt unit 120 on both front and back sides as is the case the assist system 200, if only the wire 130 on the front side is pulled, it is possible to more easily detect a rotational movement of the loose knee belt unit 120 about the Y-axis as shown in FIG. 11(*b*) and FIG. 11(*c*). That is, it becomes possible for the judgment unit 102 to more easily judge whether the knee belt unit 120 is in a loose state based on time-series data in terms of angular velocity about the Y-axis measured by the movement measurement unit 121 disposed on the knee belt unit 120.

Figure 12:
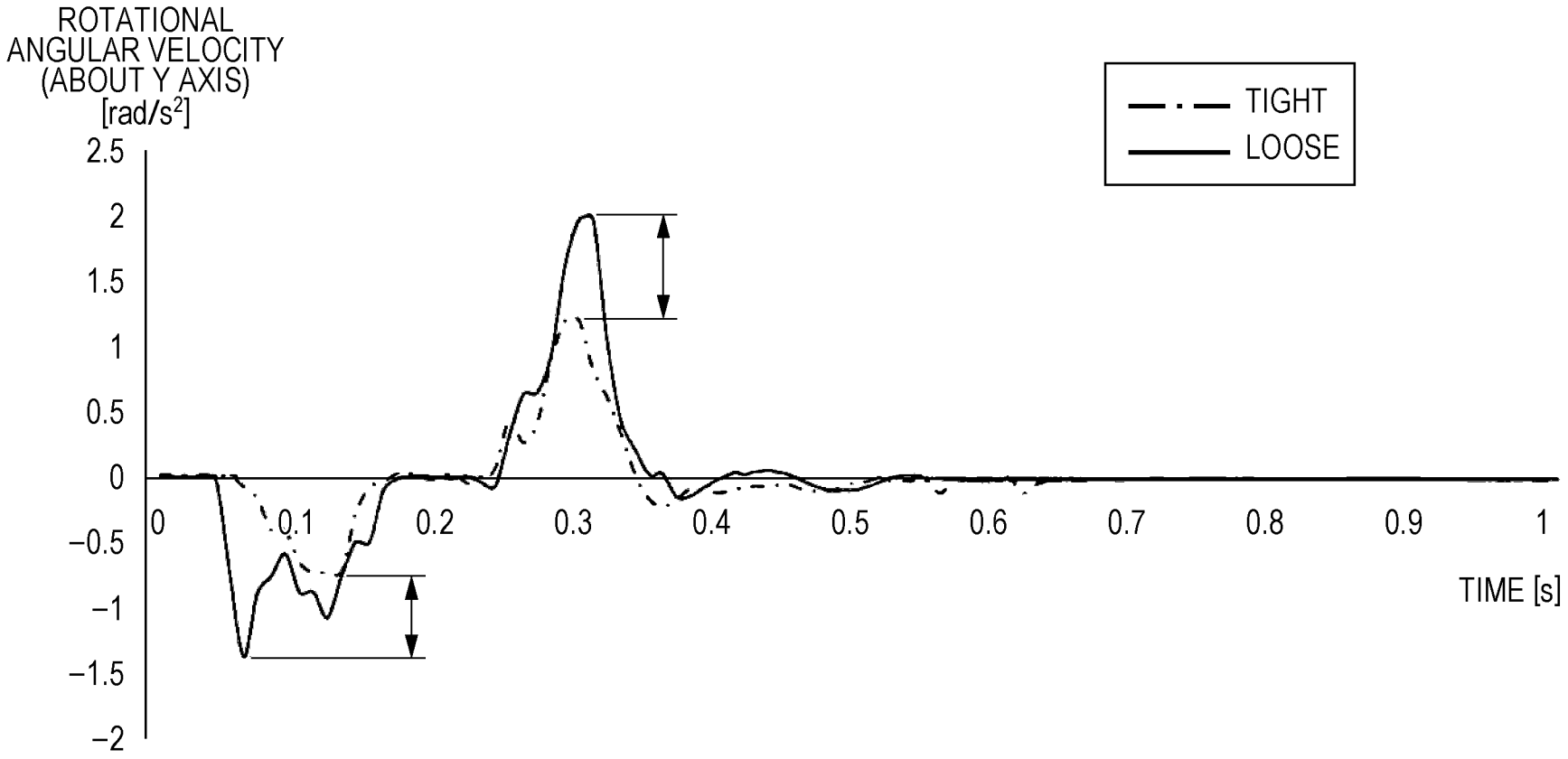
FIG. 12 is a graph showing a change in an angular velocity of a knee belt unit about a Y-axis direction when a first tension is applied to a wire by inputting a pulse-wave calibration signal.

FIG. 12 is a graph showing, like FIG. 10, a change in angular velocity of the knee belt unit 120 about the Y-axis that occurs when a calibration signal of a pulse wave with w=0.2 sec and h=100 N is input to the drive controller 111 thereby applying a first tension to the wire 130. In the graph shown in FIG. 12, a horizontal axis represents time, and a vertical axis represent the angular velocity about the Y-axis. In this graph, a dash-dot line (Tight) represents an angular velocity change in a state in which the knee belt unit 120 is fastened tightly, and a solid line (Loose) represents an angular velocity change in a state in which the knee belt unit 120 is loose. As shown in FIG. 12, a greater change in the angular velocity change about Y-axis occurs in the case where the knee belt unit 120 is in the loose state than in the case where the knee belt unit 120 is fastened tightly. Therefore, as in the case where the looseness of the knee belt unit 120 is judged based on the acceleration change in the X-axis direction, the judgment unit 102 may perform the judgement such that when the calibration signal of the pulse wave corresponding to the first tension (h=100 N) is input, if an angular velocity about Y-axis greater than or equal to the particular threshold value (for example, 1.5 rad/s$^2$) occurs, then the judgment unit 102 determines that the knee belt unit 120 is in a loose state.

Figure 13:
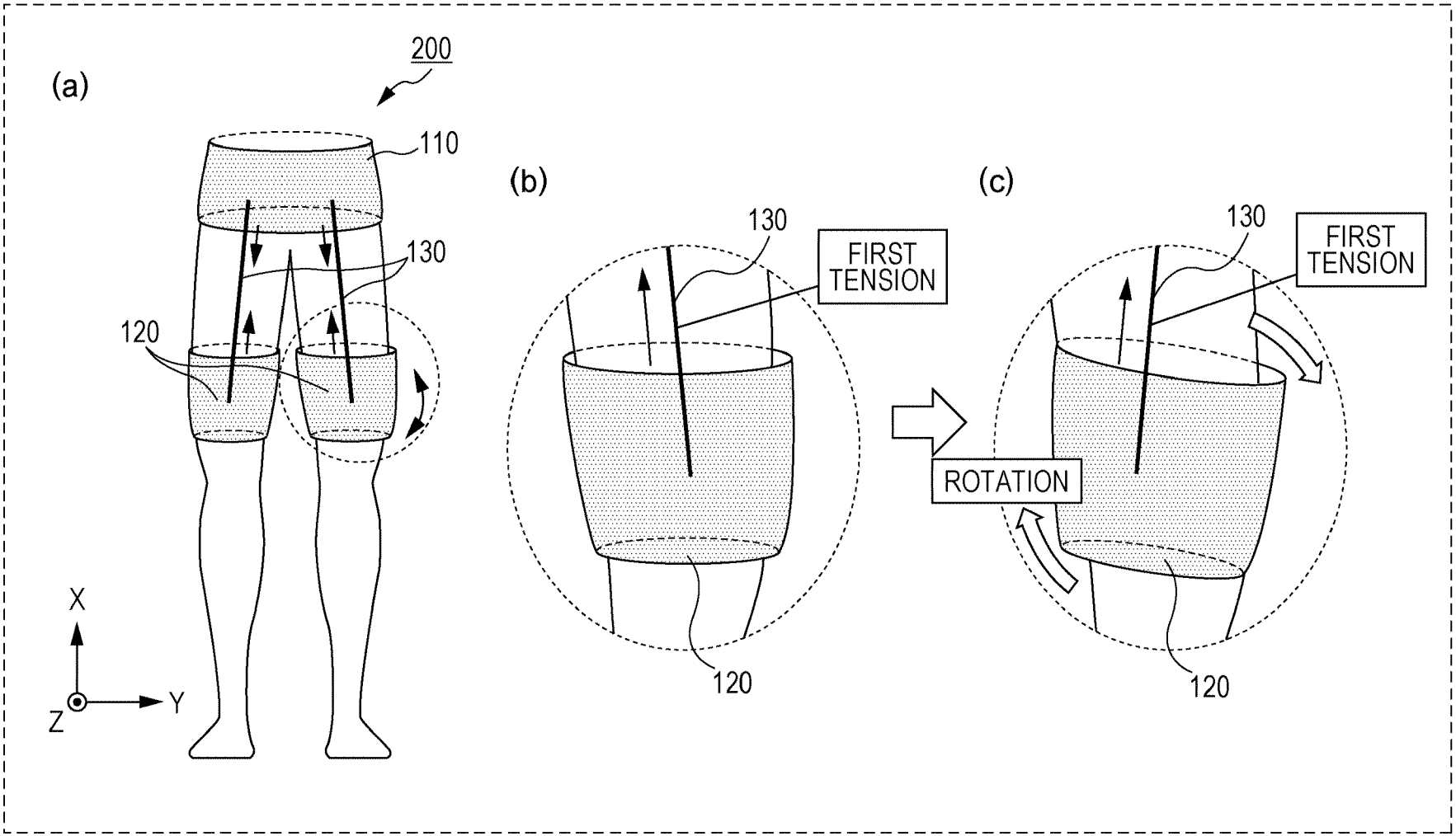
FIG. 13 is a diagram illustrating a rotational movement of a knee belt unit about a Z-axis direction when a first tension is applied to a wire.

The judgment unit 102 may perform judgement as to the looseness and/or the shift of the knee belt unit 120 based on the magnitude of the angular velocity about the Z-axis in a similar manner to the angular velocity about the Y-axis. FIG. 13 is a diagram illustrating a rotational movement of the knee belt unit 120 about the Z-axis that occurs when the first tension is applied to the wire 130. More specifically, FIG. 13(*a*) illustrates the assist system 200 seen from the Z-axis direction in a state in which the first tension is applied to the wire 130. FIG. 13(*a*) and FIG. 13(*c*) each illustrate an enlarged view of the knee belt unit 120 shown in FIG. 13(*a*). Each of these figures shows a manner in which the knee belt unit 120 moves when the first tension is applied to the wire 130.

As shown in FIG. 13(*a*) and FIG. 13(*b*), when the wire 130 is pulled in a situation in which the knee belt unit 120 is in a loose state, the knee belt unit 120 moves not only in the longitudinal direction of the wire 130 (in the X-axis direction) and rotationally about Y-axis but also moves rotationally about the Z-axis shown in FIG. 13(*c*).

Figure 14:
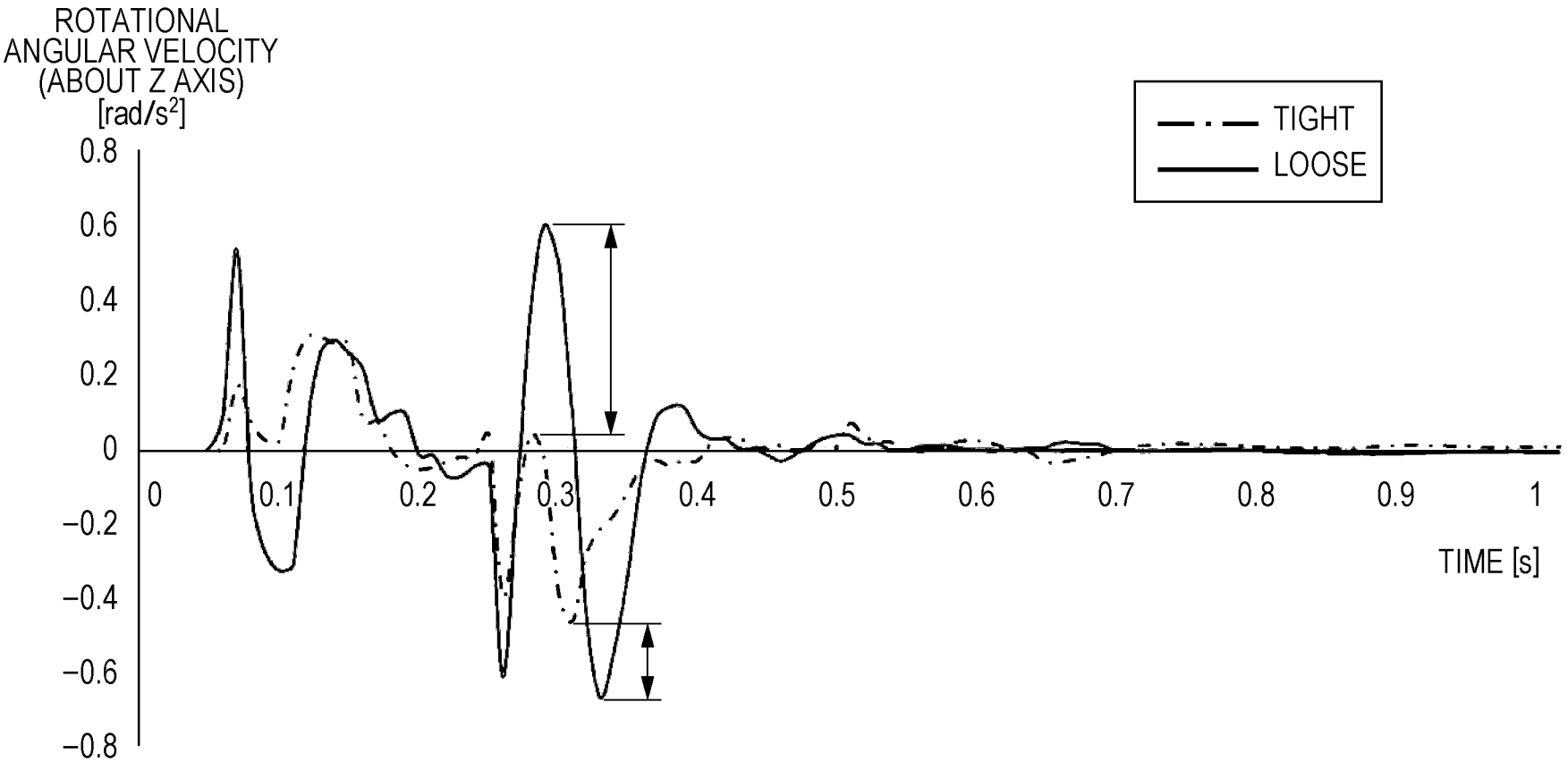
FIG. 14 is a graph showing an angular velocity of a knee belt unit about a Z-axis direction when a first tension is applied to a wire by inputting a pulse-wave calibration signal.

FIG. 14 is a graph showing, like FIG. 10 and FIG. 12, an angular velocity of the knee belt unit 120 about the Z-axis that occurs when a calibration signal of a pulse wave with w =0.2 sec and h=100 N is input to the drive controller 111 thereby applying a first tension to the wire 130. In the graph shown in FIG. 14, a horizontal axis represents time, and a vertical axis represents the angular velocity about the Z-axis. In this graph, a dash-dot line (Tight) represents an angular velocity change in a state in which the knee belt unit 120 is fastened tightly, and a solid line (Loose) represents an angular velocity change in a state in which the knee belt unit 120 is loose. As shown in FIG. 14, a greater change in the angular velocity about Z-axis occurs in the case where the knee belt unit 120 is in the loose state than in the case where the knee belt unit 120 is fastened tightly. Therefore, as with the method of judging the looseness of the knee belt unit 120 based on the acceleration change in the X-axis direction or with the method of judging the looseness of the knee belt unit 120 based on the angular velocity change about the Y-axis, the judgment unit 102 may performed judgment such that when the calibration signal of the pulse wave corresponding to the first tension (h=100 N) is input, if an angular velocity about the Z-axis greater than or equal to the particular threshold value (for example, 0.4 rad/s$^2$) occurs, the judgment unit 102 may judge that the knee belt unit 120 is in a loose state.

In the example described above, it is assumed by way of example that the judgment unit 102 performs the judgement as to the looseness of the knee belt unit 120 by detecting the acceleration in the X-axis direction the angular velocity about the Y-axis, and the angular velocity about the Z-axis. However, the judgment method is not limited to the example described above. For example, when the acceleration about the X-axis and the angular velocity about the Y-axis are both greater than or equal to respective particular threshold values, the judgment unit 102 may determine that the knee belt unit 120 is in a loose state. Alternatively, the judgment unit 102 may check changes in the angular velocity about the Z-axis in addition to the acceleration in the X-axis direction and the angular velocity about the Y-axis, and when values output from the corresponding sensors indicate that all these three values are greater than or equal to respective particular threshold values, the judgment unit 102 may determine that the knee belt unit 120 is in a loose state. The judgment unit 102 may determine whether the knee belt unit 120 is in a loose state by determining whether at least the change in the angular velocity about the Y-axis is greater than or equal to the particular threshold value. The judgment unit 102 may determine that the knee belt unit 120 is in a loose state when the angular velocity about the Y-axis is greater than or equal to the corresponding particular threshold value and the acceleration in the X-axis direction is greater than or equal to the corresponding particular threshold value. The judgment unit 102 may determine that the knee belt unit 120 is in a loose state when the angular velocity about the Y-axis is greater than or equal to the corresponding particular threshold value and the angular velocity about the Z-axis is greater than or equal to the corresponding particular threshold value. By employing one of the judgment methods, the judgment unit 102 is capable of making high-accuracy judgement as to the looseness of the knee belt unit 120.

In the above example, the judgment unit 102 judges the looseness of the knee belt unit 120 based on the acceleration change in the X-axis direction, the angular velocity change about the Y-axis, and the angular velocity change about the Z-axis such that when the calibration signal that causes a first tension (h=100 N) to be applied to the wire 130 is input, if the acceleration change in the X-axis direction, the angular velocity change about the Y-axis, and the angular velocity change about the Z-axis that occur in response to the calibration signal are respectively greater than or equal to 2.5 m/s$^2$, 1.5 rad/s$^2$, and 0.4 rad/s$^2$, then the judgment unit 102 determines that the knee belt unit 120 is in a loose state. However, the judgement is not limited to this example. For example, when a calibration signal that causes a first tension in a range from 50 to 400 N to be applied to the wire 130 is input, if the resultant acceleration and angular velocity changes are respectively greater than or equal to 1.2 m/s$^2$, 1.0 rad/s$^2$, and 0.3 rad/s$^2$, the judgment unit 102 may judge that the knee belt unit 120 is in a loose state.

Note that the value of the first tension applied by the calibration signal, and the particular threshold value in terms of at least one of the acceleration change in the X-axis direction, the angular velocity change about the Y-axis, and the angular velocity change about the Z-axis may be set depending on each user, and the judgement of the looseness and/or the shift of the knee belt unit 120 may be performed using the calibration signal and the particular threshold value set for the user. In this case, the assist system 200 may include an accepter that accepts a preference from a user. The accepter may be realized, for example, using an input interface such as a button, a switch, an input key, a touch panel or the like, and a processor, a memory, and the like.

For example, the fastening state and/or the feeling of the knee belt unit 120 varies depending on the user. Therefore, at the time when the assist system 200 is used for the first time and/or at proper times, periodically, after the use of the assist system 200 is started, the user may tightly re-fasten the knee belt unit 120 and values of the acceleration change and the angular velocity change of the knee belt unit 120 that occur in the state in which the knee belt unit 120 is tightly refastened may be stored. According to the stored values, the particular threshold values for use in the judgment of the looseness and/or the shift of the knee belt unit 120 may be set. For example, for a user who prefers a tightly fastened state, the particular threshold value may be set to be smaller, for example, by 5 to 20% than the initial value (the standard value). On the other hand, for a user who prefers a loosely fastened state, the particular threshold value may be set to be greater, for example, by 5 to 20% than the standard value. That is, the assist system may further include an accepter that accepts setting by a user and a storage unit that stores the setting accepted via the accepter. The controller may adjust the first threshold value according to the setting stored in the storage unit, and may output information indicating a result of the judgement performed using the adjusted first threshold value.

Even in a case where the fastening state varies depending on a preference of a user or the fastening state varies, even for the same user, day by day depending on clothes the user wears, it is possible to properly judge the looseness and/or the shift of the knee belt unit 120 by changing the particular threshold value for use in the judgment of the shift of the knee belt unit 120 to a proper different value depending on the difference.

In the present embodiment, as described above, when the wire 130 is pulled, a response to the pulling is detected not only in terms of a change in acceleration of the knee belt unit 120 in the X-axis direction but also in terms of an angular velocity change, and more specifically, angular velocity changes about the right-left direction (the Y-axis direction) and the forward-backward direction (Z-axis direction) of a user, and the determination is performed as to whether the detected changes are greater than or equal to respective corresponding threshold values thereby accurately judging the looseness and/or the shift of the knee belt unit 120.

To clearly detect an angular velocity change, the movement measurement unit 121 and the wire 130 may be disposed at particular positions, and the knee belt unit 120 may be fixed by a particular method, as described below.

First, a description is given below as to the position of the movement measurement unit 121 for measuring the angular velocity about the Y-axis direction and the position where the wire 130 is connected to the knee belt unit 120.

Figure 15:
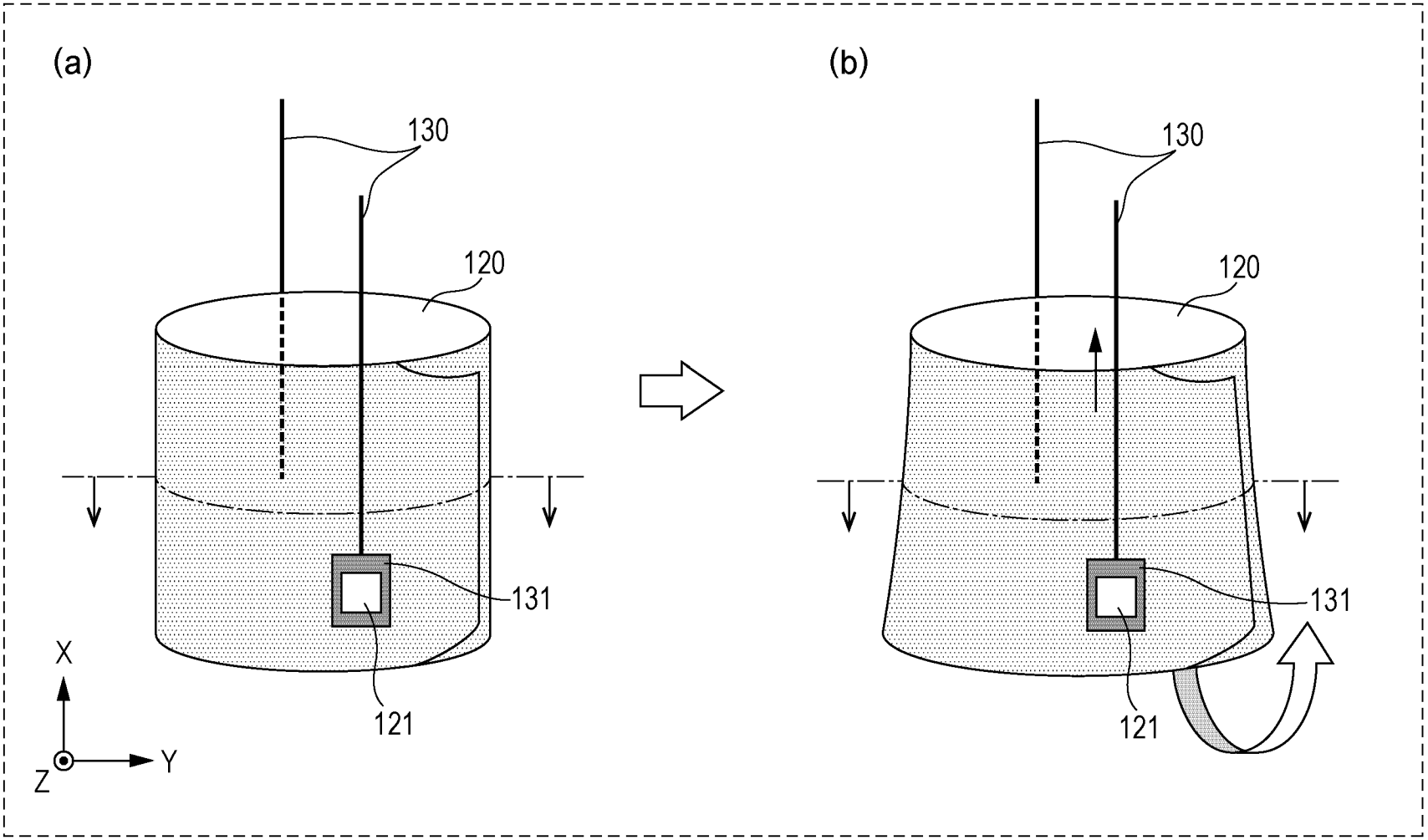
FIG. 15 is a diagram illustrating an example of a location of a movement measurement unit and a wire on a knee belt unit.

FIG. 15 is a diagram illustrating an example of a position of the movement measurement unit 121 and an example of a position where the wire 130 is connected to the knee belt unit 120.

As shown in FIG. 15, the movement measurement unit 121 and a connection part 131 where the wire 130 is connected to the knee belt unit 120 having a substantially barrel shape where the movement measurement unit 121 is denoted by an open square while the connection part 131 is denoted by a solid square. As shown in FIG. 15(*a*), the acceleration sensor 122 and the gyrosensor 123 of the movement measurement unit 121 and the connection part 131 where the wire 130 is connected to the knee belt unit 120 are all located in a lower-half area (apart in the negative X-axis direction from the center line, as seen in the X-axis direction, of the knee belt unit 120). In the example shown in FIG. 15, the location of the movement measurement unit 121 overlaps the location of the connection part 131. In FIG. 15, a dash-dot line denotes the center line, as seen in the X-axis direction, of the knee belt unit 120. In the above-described arrangement in which the movement measurement unit 121 and the connection part 131 are disposed in the lower-half area of the knee belt unit 120 as described above, when the first tension is applied via the wire 130, if the knee belt unit 120 is in a loose state, then the lower-half area of the knee belt unit 120 moves such that it lifts upward (in the position direction of the X-axis direction). Because this arrangement makes it possible for the lower-half part of the knee belt unit 120 to easily lift up, a large angular velocity change about the Y-axis direction is obtained even in a case where the first tension applied via the wire 130 is small, and thus it becomes possible for the judgment unit 102 to easily judge the looseness of the knee belt unit 120.

In the example described above, it is assumed by way of example that the location of the movement measurement unit 121 overlaps the location of the connection part 131 where the wire 130 is connected to the knee belt unit 120. However, the locations are not limited to those in this example. The movement measurement unit 121 and the connection part 131 may be disposed at other locations, for example, below the center line of the knee belt unit 120.

Figure 16:
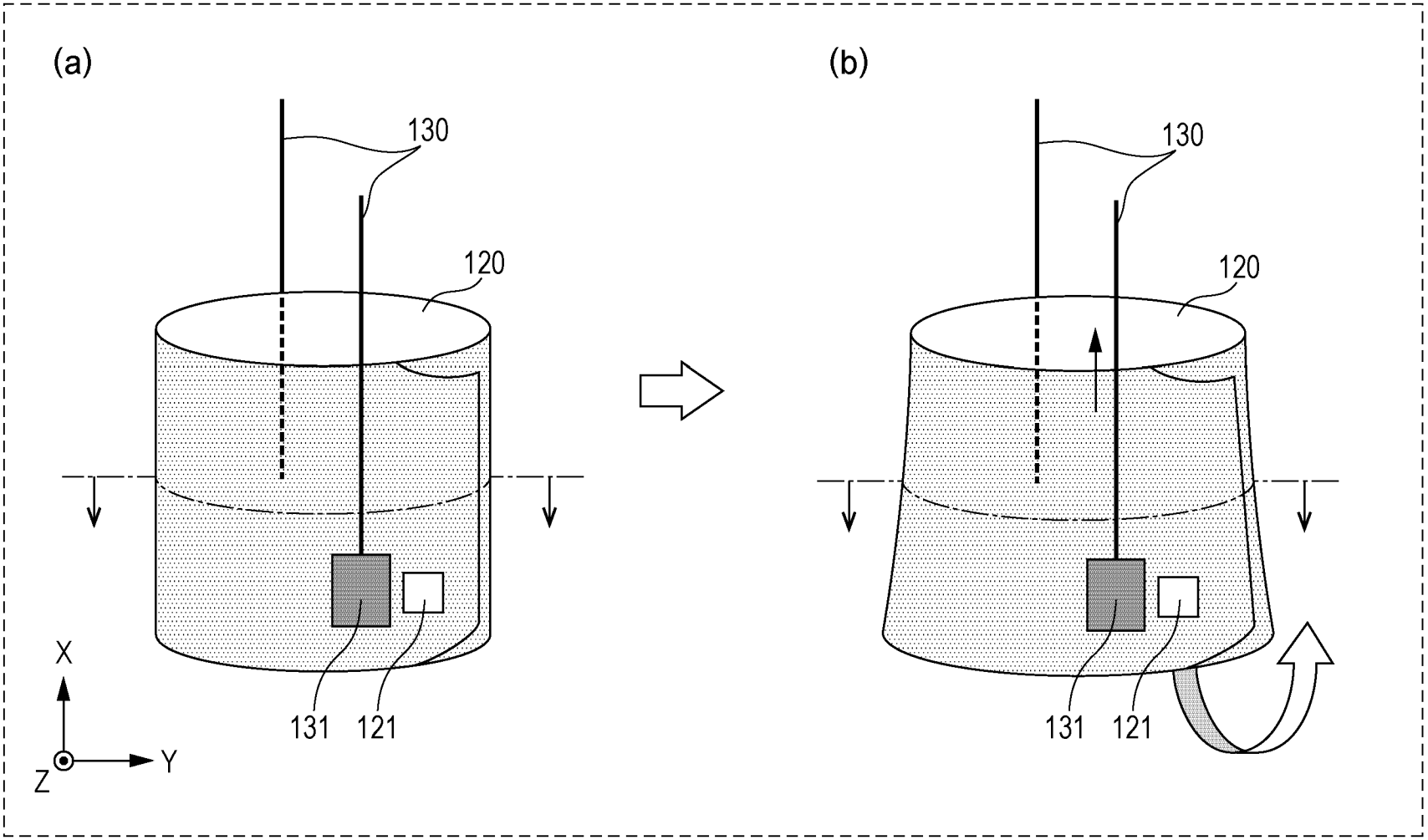
FIG. 16 is a diagram illustrating another example of a location of a movement measurement unit and a wire on a knee belt unit.

The movement measurement unit 121 and the connection part 131 may be disposed such that the locations thereof are closer to a lower end of the knee belt unit 120. As the location of the connection part 131 is closer to the lower end of the knee belt unit 120, a greater rotation is obtained about the Y-axis direction when the first tension is applied in a situation in which the knee belt unit 120 is in a loose state. As the locations of the acceleration sensor 122 and the gyrosensor 123 of the movement measurement unit 121 are closer to one of ends, in the X-axis direction, of the knee belt unit 120, a greater rotation component is given by the knee belt unit 120. However, the locations of the acceleration sensor 122 and the gyrosensor 123 of the movement measurement unit 121 are not involved in the actual rotation of the knee belt unit 120. Therefore, priority may be given to the location of the connection part 131 of the wire 130, and the connection part 131 of the movement measurement unit 121 may be determined in the lower-half area of the knee belt unit 120 after the location of the connection part 131 of the wire 130 is determined. That is, the movement measurement unit 121 and the wire 130 may be disposed on the knee belt unit 120 such that the condition described above is satisfied, for example, as shown in FIG. 16(*a*). That is, when the location of the movement measurement unit 121 does not overlap the location of the connection part 131, if the above-described condition is satisfied, it is possible for the judgment unit 102 to more effectively acquire the angular velocity about the Y-axis direction as shown in FIG. 16(*b*), which makes it possible to more easily judge the looseness of the knee belt unit 120.

Next, to measure the angular velocity about the Z-axis direction, the location of the movement measurement unit 121 and the location of the connection part where the wire 130 is connected to the knee belt unit 120 may be disposed as described below.

Figure 17:
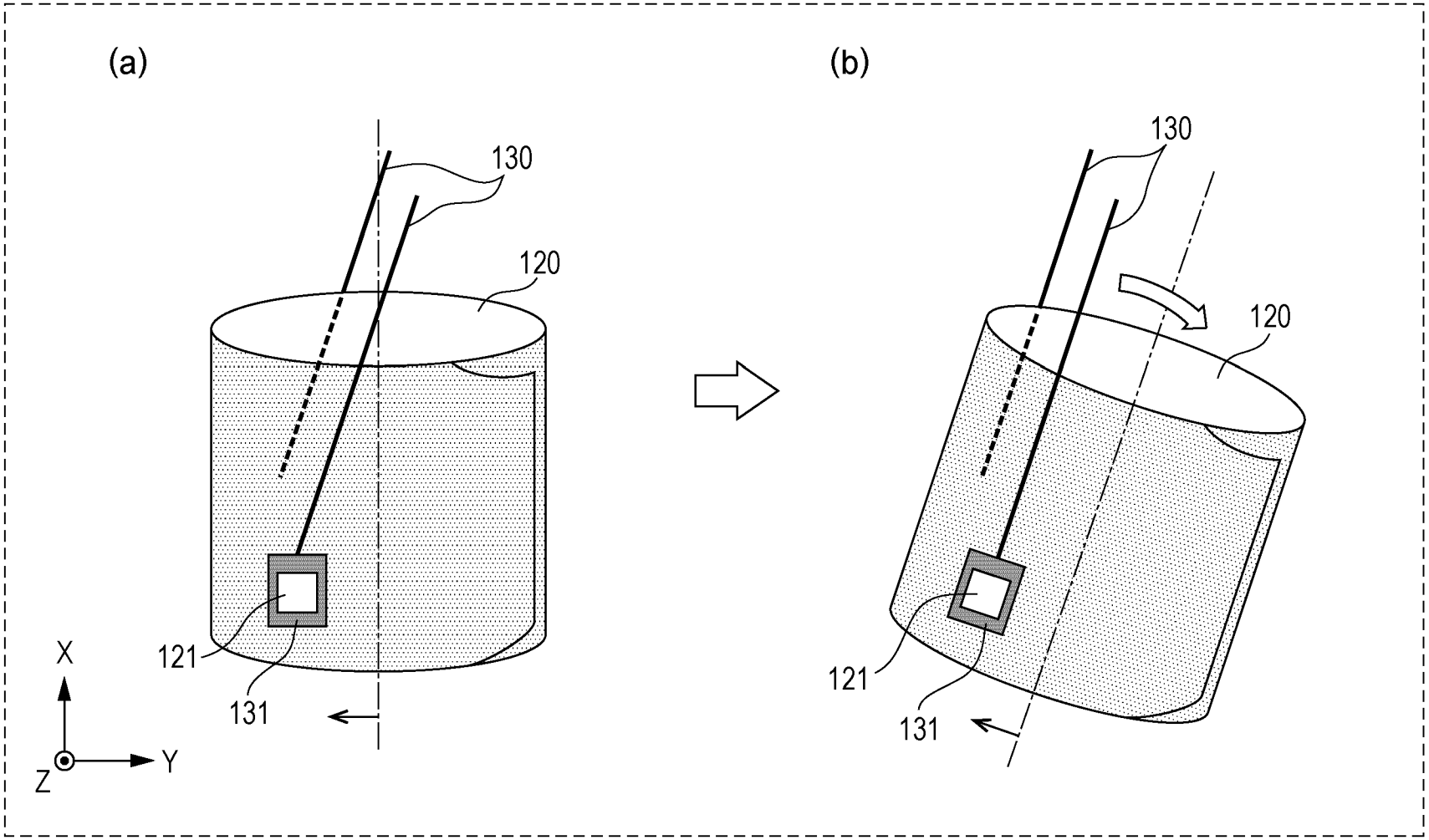
FIG. 17 is a diagram illustrating another example of a location of a movement measurement unit and a wire on a knee belt unit.

FIG. 17 is a diagram illustrating an example of a location of the movement measurement unit 121 and a location of the connection part where wire 130 is connected to the knee belt unit 120.

Figure 18:
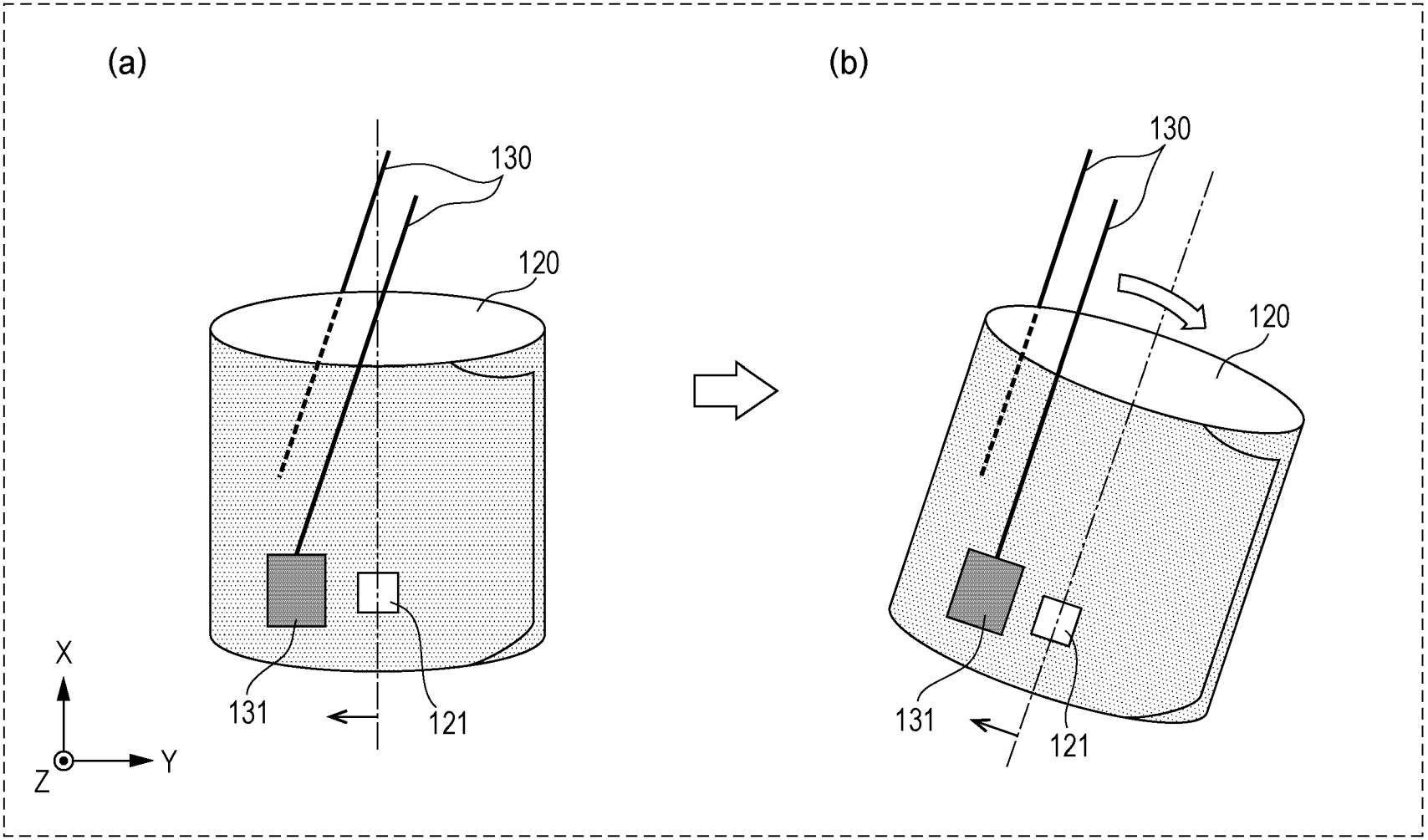
FIG. 18 is a diagram illustrating another example of a location of a movement measurement unit and a wire on a knee belt unit.

As shown in FIG. 17(*a*), the movement measurement unit 121 and the connection part 131 are disposed, on the knee belt unit 120, on one of sides opposing each other in the Y-axis direction via the center of the knee belt. The movement measurement unit 121 and the connection part 131 may be disposed such that when the locations of the movement measurement unit 121 and the connection part 131 are seen from the Z-axis direction, the movement measurement unit 121 and the connection part 131 are rotated about a rotation center, defined by of the center axis of the circular cylinder of the knee belt unit 120, within an angle range from 20° to 80° in one rotational direction with reference to 0° defined in the forward direction of a user (in the positive direction of the Z-axis direction). In FIG. 17 a dash-dot line denotes the center line, as seen in the Y-axis direction, of the knee belt unit 120. This makes it possible to obtain a greater rotation about the Z-axis direction as can be seen from FIG. 17(*b*). Note that the location of the movement measurement unit 121 does not necessarily need to overlap the location of the connection part 131 as described above with reference to FIG. 16. For example, as shown in FIG. 18(*a*), on the knee belt unit 120, the movement measurement unit 121 may be disposed at the center as seen in the Y-axis direction, and the connection part 131 is disposed at a location shifted in the positive or negative direction from the center. This makes it possible, as shown in FIG. 18(*b*), for the judgment unit 102 to more effectively acquire the angular velocity about the Z-axis direction, which makes it possible to more easily judge the looseness or the shift of the knee belt unit 120.

Figure 19:
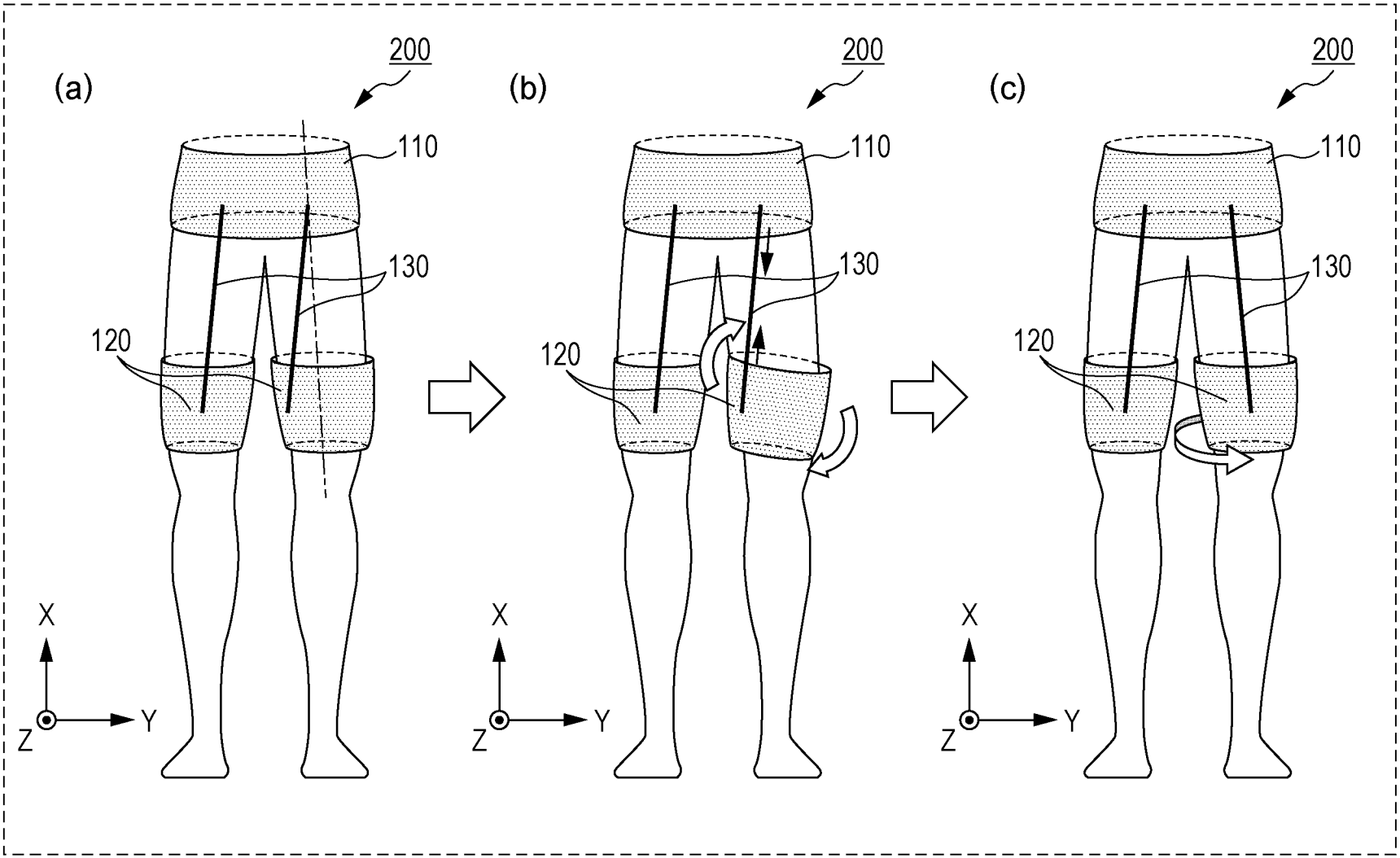
FIG. 19 is a diagram illustrating an example of a method of making a judgment as to a wearing position shift of a knee belt unit.

Furthermore, to make it possible to more effectively judge the looseness or the shift of the knee belt unit 120, the wire 130 and the movement measurement unit 121 may be disposed at locations that allow it to more easily measure both the angular velocities about the Y-axis and Z-axis directions. For example, as shown in FIG. 17 and FIG. 19, it is desirable that, the locations, on the knee belt unit 120, of the movement measurement unit 121 and the connection part 131 be in a lower-half area of the knee belt unit 120. The location of the connection part 131 may be shifted from the center, as seen in the Y-axis direction, of the knee belt unit 120 in the positive or negative direction of the Y-axis direction. This makes it possible for the judgment unit 102 to more effectively acquire the angular velocity about the Y-axis direction and the angular velocity about the Z-axis direction, which makes it possible to more easily judge the looseness of the knee belt unit 120 based on the acquired two pieces of information.

In the present embodiment, the length of the knee belt unit 120 in the X-axis direction may be twice or greater than the size of the connection part 131 of the wire 130 or the size of the movement measurement unit 121. This makes it possible to dispose the connection part 131 of the wire 130 and the movement measurement unit 121 such that they are located in the lower-half area of the knee belt unit 120, which makes it possible to more effectively provide a rotational component about the Y-axis direction.

In the example described above, it is assumed by way of example that the judgment unit 102 uses the angular velocity about the Z-axis direction to detect the looseness of the knee belt unit 120. However, the angular velocity about the Z-axis direction may also be used by the judgment unit 102, for example, to detect a shift of the wearing position of the knee belt unit 120. That is, the judgment unit 102 may determine whether the knee belt unit 120 is shifted from a correct wearing position based on the change in the angular velocity about the Z-axis direction. The assist system 200 may be realized in the form of an assist suit that assists movements of two legs (hip joints) of a user. In this case, ideally, wires 130 may be provided such that they extend between the upper-body belt unit 110 and the knee belt units 120 in the gravitational direction (that is, the X-axis direction) as shown in FIG. 4.

Next, a method of judging the wearing position shift of the knee belt unit 120 is described below with reference to FIG. 19.

FIG. 19 is a diagram illustrating an example of a method of making a judgment as to a wearing position shift of the knee belt unit 120. FIG. 19(*a*) illustrates a situation in which a user wears the knee belt unit 120 such that the location of a wire 130 is shifted from its ideal position represented by a broken line. In the example shown in FIG. 19(*a*), a knee belt unit 120 worn around a left knee of the user is rotationally shifted in a rightward direction as seen from the user. In this situation, if the wire 130 is pulled by applying a first tension to the wire 130, the knee belt unit 120 has a rotation about the Z-axis direction as shown in FIG. 19(*b*). When the rotation about the Z-axis direction is detected as in this example, the controller 100 may present information to the user to prompt that the wearing position of the knee belt unit 120 is to be rotated to the left such that the connection position where the wire 130 is connected to the knee belt unit 120 comes to the center of the front side of the user as shown in FIG. 19(*c*).

In a case where the wearing position of the knee belt unit has a deviation to the left as opposed to the example described above, the judgment may be performed in a similar manner.

Figure 20:
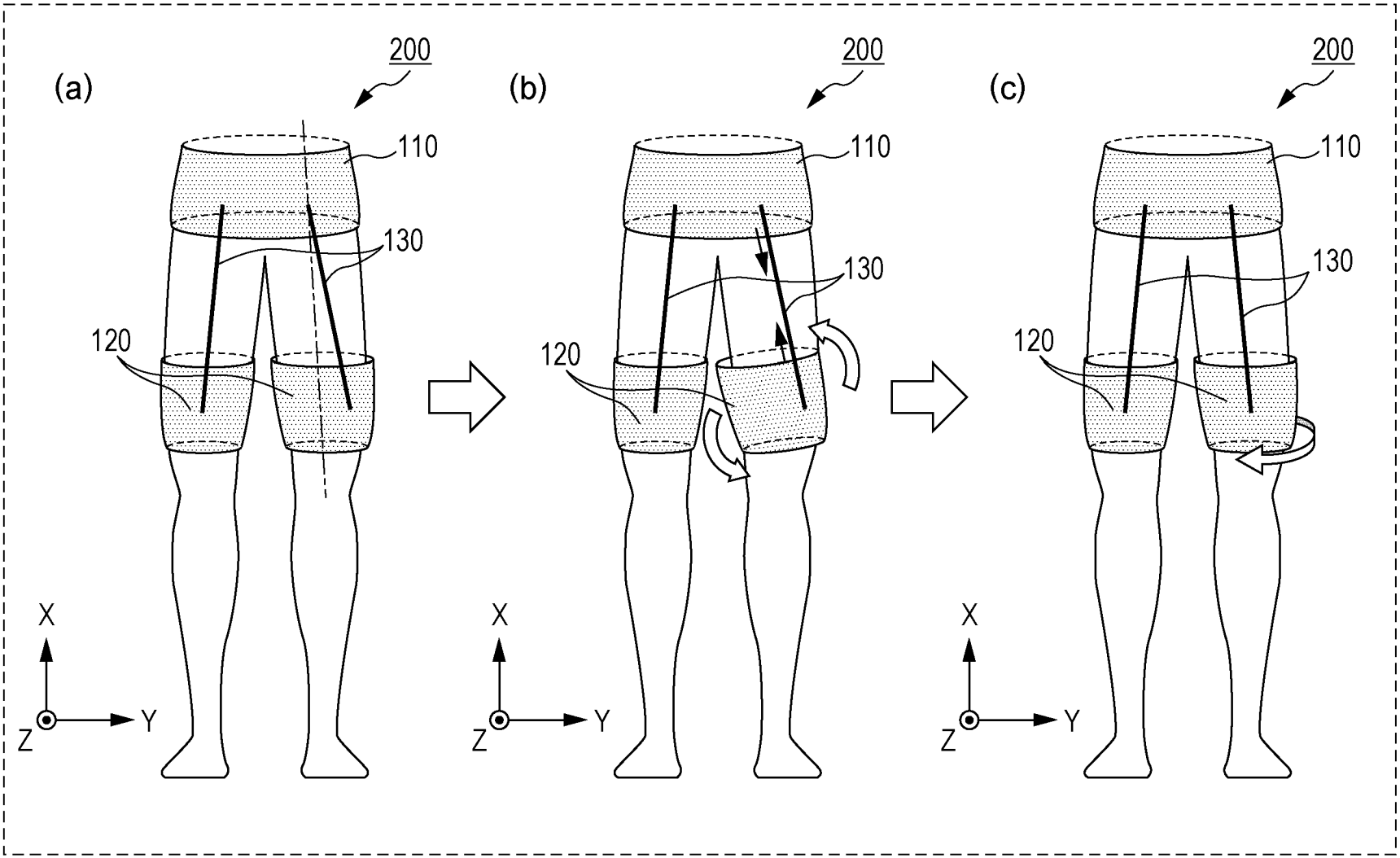
FIG. 20 is a diagram illustrating another example of a method of making a judgment as to a wearing position shift of a knee belt unit.

FIG. 20 is a diagram illustrating another example of a method of making a judgment as to the wearing position shift of the knee belt unit 120. FIG. 20(*a*) illustrates a situation in which a user wears the knee belt unit 120 such that the location of a wire 130 is shifted from its ideal position represented by a broken line. In the example shown in FIG. 20(*a*), a knee belt unit 120 worn around a left knee of the user is rotationally shifted in a leftward direction as seen from the user. In this situation, if the wire 130 is pulled by applying a first tension to the wire 130, the knee belt unit 120 has a rotation about the Z-axis direction as shown in FIG. 20(*b*). When the rotation about the Z-axis direction is detected as in this example, the controller 100 may present information to the user to prompt that the wearing position of the knee belt unit 120 is to be rotated to the right such that the connection position where the wire 130 is connected to the knee belt unit 120 comes to the center of the front side of the user as shown in FIG. 20(*c*).

In the examples described above with reference to FIG. 19 and FIG. 20, it is assumed by way of example that the judgement is performed as to the wearing position shift of the knee belt unit 120 worn on the left knee of the user. Note that the it is possible to make a judgement in a similar manner as to the wearing position shift of the knee belt unit 120 worn around the right knee of the user.

When the rotation of the knee belt unit 120 about the Z-axis direction is detected, there can be following two possibilities: a first possibility that the rotation is due to a looseness of the knee belt unit 120; and a second possibility that the rotation is due to a wrong wearing position of the knee belt unit 120. When a rotation about the Z-axis direction is detected, the determination as to whether the rotation is due to the looseness or the wearing position shift of the knee belt unit 120 may be performed assuming that the rotation is due to the wearing position shift. More specifically, in a case where the angular velocity about the Z-axis direction (about the forward-backward direction of a user) is greater than or equal to a first threshold value, the controller 100 may output information indicating that the knee belt unit 120 is in a shifted state without outputting information indicating that the knee belt unit 120 is in a loose state. A reason for this is as follows. When a user corrects a wearing position shift, there is a high probability that the knee belt unit 120 is loosened once and then the knee belt unit 120 is refastened. Therefore, even if the rotation about the Z-axis direction is actually due to a looseness of the knee belt unit 120, it is very likely that the looseness of the knee belt unit 120 will be eliminated when the knee belt unit 120 is refastened by the user.

In a case where not only the angular velocity about the Z-axis direction but also the angular velocity about the Y-axis direction and/or the angular velocity about the X-axis direction are also large, and more specifically, in a case where they are greater than or equal to corresponding particular threshold values, the controller 100 may present information to the user to prompt that the wearing position shift of the knee belt unit 120 is to be corrected and the knee belt unit 120 is to be refastened more tightly than before.

In a case where the angular velocity change about the Z-axis direction is greater than or equal to the particular threshold value and the angular velocity change about the Y-axis direction is smaller than or equal to the corresponding particular threshold value, the controller 100 may determine that the knee belt unit 120 is not in a loose state but the knee belt unit 120 has a wearing position shift. In a case where in addition to the above, the angular velocity change about the X-axis direction is also smaller than or equal to the corresponding particular threshold value, the controller 100 may also determine that the knee belt unit 120 is not in a loose state but the knee belt unit 120 has a wearing position shift. Conversely, in a case where the angular velocity change about the Z-axis direction is smaller than the corresponding particular threshold value and the angular velocity change about the Y-axis direction is greater than or equal to the corresponding particular threshold value or the angular velocity change about the X-axis direction is greater than or equal to the corresponding particular threshold value, the controller 100 may determine that the knee belt unit 120 is in a loose state but there is no wearing position shift.

1.1.5 Presentation Unit

The presentation unit 140 is a unit that presents to a user a result of the judgment made by the judgment unit 102 as to the looseness or the shift of the knee belt unit 120 worn on a user. More specifically, a vibration actuator may be disposed on the knee belt unit 120 to present information such that when the judgment unit 102 determines that the knee belt unit 120 is in a loose state or there is a wearing position shift, the vibration actuator is vibrated in a particular rhythm thereby informing a user that the knee belt unit 120 is in a loose state or there is a wearing position shift. That is, the presentation unit 140 may be realized using the vibration actuator. The vibration pattern may be changed depending on whether the knee belt unit 120 is loose or has a wearing position shift.

In a case where the knee belt unit 120 is in a loose state, there is a possibility that a user is not aware of the vibration unless the vibration actuator is vibrated with a large vibration magnitude. When the controller 100 determines that the knee belt unit 120 is in a loose state, the controller 100 may increase the tension of the wire 130, for example, to 200 N and may vibrate the vibration actuator, for example, at 2 Hz. On the other hand, in the case where it is determined that the knee belt unit 120 has a wearing position shift, there is a possibility that there is no a looseness. Therefore, the tension of the wire 130 may be set to a value, for example, 100 N, smaller than in the case where the knee belt unit 120 is in the loose state, and the vibration actuator may be vibrated, for example, at 5 Hz. Note that the vibration patterns are not limited to the examples described above, but other vibration patterns may be employed according to user's preference.

In a case where the controller 100 determines that only the knee belt unit 120 worn on a right leg has a looseness or a wearing position shift, the controller 100 may vibrate only the vibration actuator disposed on the knee belt unit 120 worn on the right leg. On the other hand, in a case where the controller 100 determines that only the knee belt unit 120 worn on a left leg has a looseness or a wearing position shift, the controller 100 may vibrate only the vibration actuator disposed on the knee belt unit 120 worn on the left leg. In a case where the controller 100 determines that both knee belt units 120 worn respectively on the right and left legs have a looseness or a wearing position shift, the controller 100 may vibrate the vibration actuators disposed on both knee belt units 120. In this way, the controller 100 may indicate which knee belt unit 120 has a looseness or a wearing position shift. The purpose of the present embodiment is to judge the looseness or the wearing position shift of the knee belt unit 120 and notify a user of the judgment result, and thus vibrating one or both of the knee belt units 120 depending on which knee belt unit 120 has a looseness or a shift is a good method of intuitively notifying the user of the judgment result.

In the example described above, it is assumed by way of example but not limitation that the presentation unit 140 presents information to a user using the vibration actuators provided on the respective knee belt units 120. However, alternatively, a vibration actuator may be disposed on the upper-body belt unit 110. For example, in a case where the looseness is so large that a user is not aware of the vibration when the knee belt unit 120 is vibrated, the user is likely not to be aware of the vibration of the actuator disposed on the knee belt unit 120. To avoid the problem described above, a vibration actuator may be disposed on the upper-body belt unit 110 which is likely to have relatively smaller a looseness, and this vibration actuator may be vibrated to effectively notify a user of the looseness of the knee belt unit 120.

In the example described above, it is assumed by way of example that the presentation unit 140 vibrates the vibration actuator disposed on the knee belt unit 120 or the upper-body belt unit 110 in response to detecting the looseness or the wearing position shift thereby presenting information to a user to notify that there is a looseness or the wearing position shift. However, the implementation of the presentation unit 140 is not limited to this example. For example, as shown in FIG. 3B, the assist system 200 may wirelessly communicate with a portable terminal 300 such as a smartphone or the like of a user thereby presenting information on the portable terminal 300. That is, the presentation unit 140 may be realized using an external device such as the portable terminal 300.

Figure 21B:
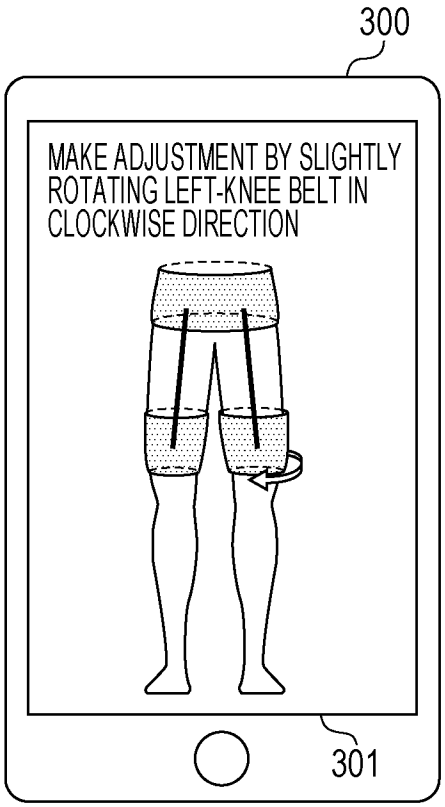
FIGS. 21A and 21B are diagrams each illustrating an example of a manner in which information is presented to a user.
Figure 21A:
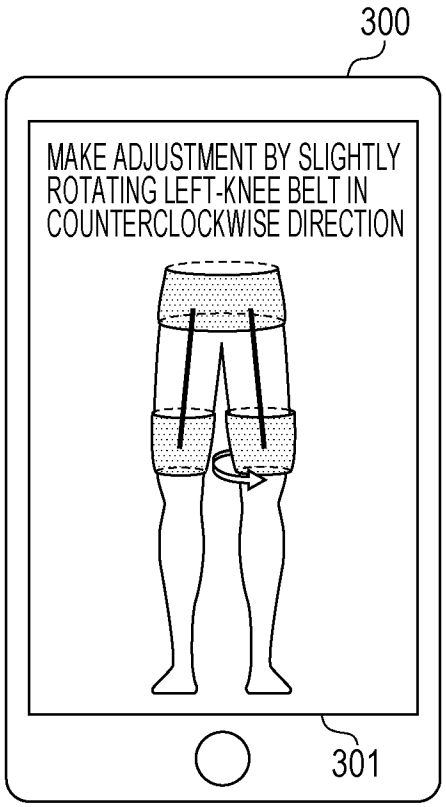

Alternatively, when the controller 100 determines that the knee belt unit 120 has a wearing position shift, the controller 100 may display, on the portable terminal 300, an image representing the assist system 200 to intuitively present an instruction to a user as shown in FIGS. 21A and 21B. FIGS. 21A and 21B each illustrate an example of information presented to a user. More specifically, FIG. 21A illustrates an example of information which is presented when it is determined that the knee belt unit 120 is rotationally shifted to the right and which prompts a user to rotate the knee belt unit 120 to the left. FIG. 21B illustrates an example of information which is presented when it is determined that the knee belt unit 120 is rotationally shifted to the left and which prompts a user to rotate the knee belt unit 120 to the right. As described above, by presenting an instruction prompting a user to correct the wearing position to a correct position by using an image of the assist system 200, it becomes possible for the user to intuitively understand the direction in which the knee belt unit 120 is to be rotated to adjust the wearing position.

1.2 Operation

Next, an operation of the assist system 200 is described below.

Figure 22:
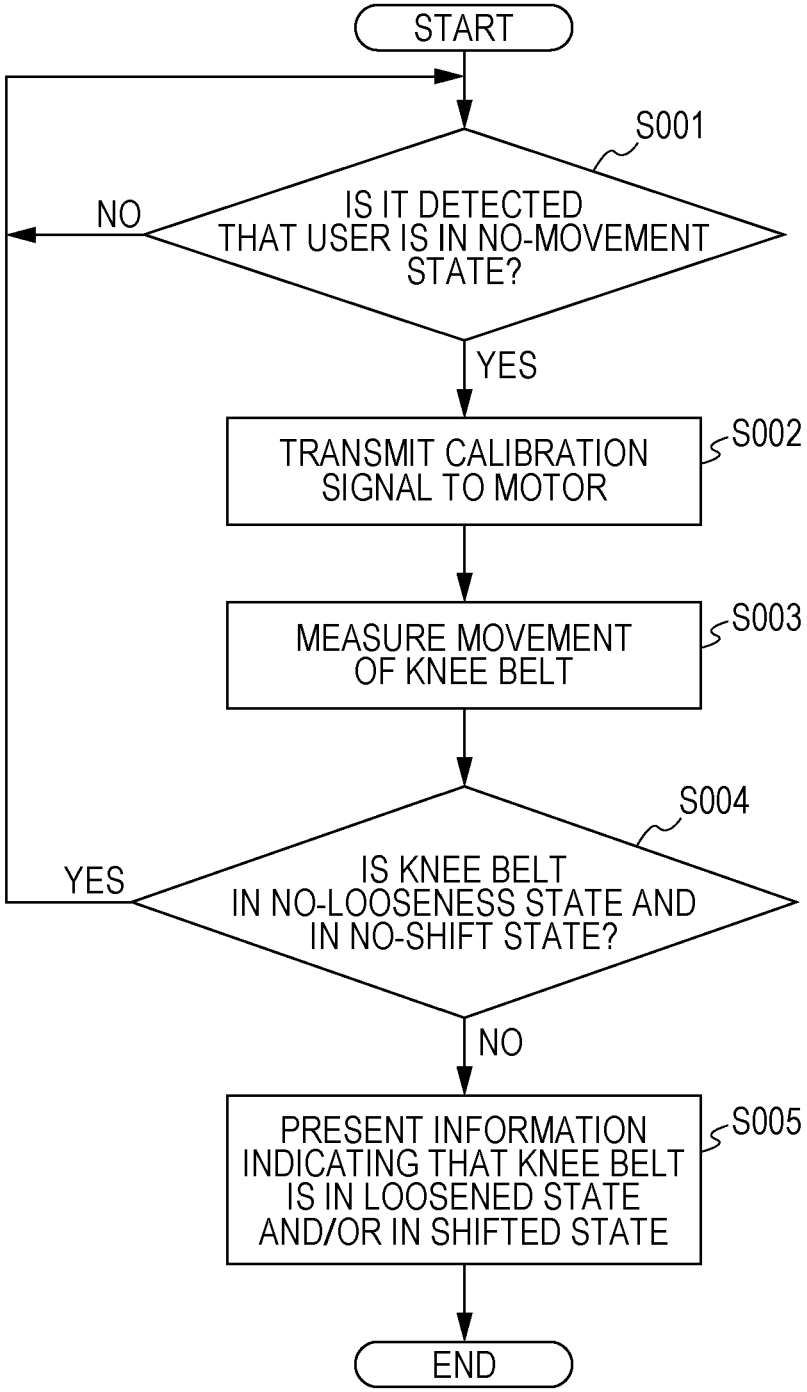
FIG. 22 is a flow chart illustrating a flow of a process performed in an assist system according to an embodiment.

FIG. 22 is a flow chart illustrating a flow of a process performed in an assist system according to an embodiment.

From a value detected by the acceleration sensor 122, the movement measurement unit 121 detects that a user is in a no-movement state (S001). More specifically, the movement measurement unit 121 determines whether a change in the acceleration measured by the acceleration sensor 122 is smaller than or equal to the second threshold value H continuously over a time period T. In a case where the acceleration change has been smaller than or equal to the second threshold value H continuously over the time period T, it is determined that the user is in a no-movement state, but otherwise it is determined that the user is not in a no-movement state.

When it is detected that the user is in the no-movement state, the movement measurement unit 121 outputs a start signal to the controller 100. As a result, the assist system 200 starts a calibration mode.

When the movement measurement unit 121 detects that a user is in a no-movement state (Yes in step S001), the calibration mode is started. In the controller 100, the signal input unit 101 determines a calibration signal for use in detecting a looseness and/or a shift of the knee belt unit 120, and the signal input unit 101 transmits the determined calibration signal to the drive controller 111 (S002). When this calibration signal is received by the drive controller 111, the drive controller 111 drives the motor 112 in accordance with the calibration signal thereby pulling the wire 130 and thus applying a pulling force (first tension) to the knee belt unit 120.

Next, the movement measurement unit 121 measures the movement of the knee belt unit 120 that occurs in the state in which the first tension is applied via the wire 130 (S003). Note that the movement measurement unit 121 may start the operation of measuring the movement of the knee belt unit 120 in a particular time before the first tension is applied, or the movement measurement unit 121 may always measure the movement of the knee belt unit 120 as long as the assist system 200 is active.

The judgment unit 102 determines whether the knee belt unit 120 is in a loose state by making a comparison between an acceleration change in the X-axis direction and a corresponding particular threshold value, and/or a comparison between an angular velocity change about the Y-axis direction and a corresponding particular threshold value, and/or a comparison between an angular velocity change about the Z-axis direction and a corresponding particular threshold value. The judgment unit 102 determines whether the knee belt unit 120 has a wearing position shift by comparing the magnitude of the change in angular velocity about the Z-axis direction with a corresponding particular threshold value (S004).

In a case where the judgment unit 102 determines that the knee belt unit 120 does not have a looseness and the knee belt unit 120 does not have a wearing position shift (Yes in S004), the processing flow returns to step S001.

Conversely, in a case where the judgement by the judgment unit 102 is that the knee belt unit 120 is in a loose state and/or the knee belt unit 120 has a wearing position shift (No in S004), the controller 100 presents information via the presentation unit 140 to notify a user that the knee belt unit 120 is in the loose state and/or the knee belt unit 120 is in the shifted state (S005).

1.3 Advantageous effects

In the assist system 200 according to the present embodiment, when a user wears the assist system 200, it is determined whether the knee belt unit 120 is in a loose state or whether the knee belt unit 120 is in a shifted state based on a magnitude of change in a value output from the acceleration sensor 122 or the gyrosensor 123 disposed on the knee belt unit 120. In a case where it is determined that the knee belt unit 120 has a looseness or a shift, information indicating a determination result is presented to a user thereby prompting the user to properly refasten the knee belt unit 120. This makes it possible to reduce the looseness and/or the shift of the knee belt unit 120 that may occur when a user wears the assist system 200, which makes it possible for the user to receive a more effective assisting force from the assist system 200.

1.4 Modifications 1.4.1 First modification

Figure 23:
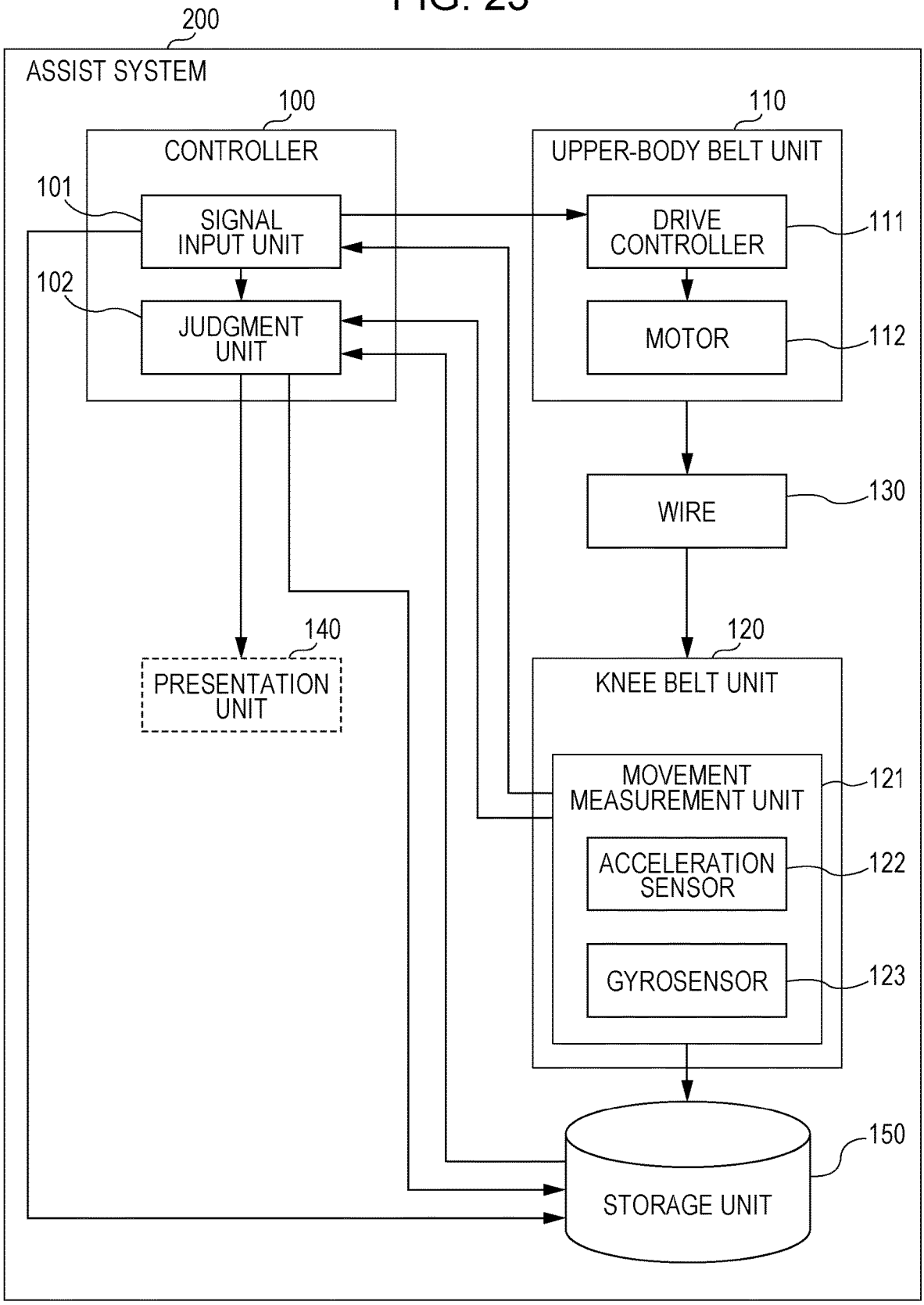
FIG. 23 is a block diagram illustrating a configuration of an assist system according to a first modification.

A modification of the embodiment provides an assist system 200A further including a storage unit 150 in addition to the elements of the assist system 200 according to the embodiment described above. FIG. 23 is a block diagram illustrating a configuration of an assist system according to a first modification.

Each time a user uses the assist system 200, the storage unit 150 stores following information together: user information; a calibration signal from the signal input unit 101; values of accelerations and angular velocities that occur in response to the calibration signal and measured by the movement measurement unit 121; and a result of judgement made by the judgment unit 102. When the assist system 200A is used for the second time or thereafter, the judgment unit 102 may check data stored in the storage unit 150 in terms of the calibration signals, the acceleration values, the angular velocity values, and past judgement results on wearing states, and if good consistency in data is found, the judgment unit 102 may employ the same judgement as one of the past judgements.

Use of the storage unit 150 in the above-described manner provides a further advantageous effect as described below. Values measured by the movement measurement unit 121 for the same user are accumulated, and a new measurement result is compared with past data stored in the storage unit 150. This makes it possible to get information, for example, as to whether the degree of looseness is great compared with the looseness in the past, or as to whether a wearing position shift occurs although the looseness is not greater than in the past. Thus, it becomes possible for the user to sensuously recognize the fastening state of the knee belt unit 120.

By storing, in the storage unit 150, patterns of measured values and fastening states of the knee belt unit 120 varying depending on conditions in terms of circumstances, clothes, and the like of the same user as described above, it becomes possible to more accurately judge the looseness of the knee belt unit 120. Depending on the user, there is a possibility that the knee belt unit 120 is always worn in a wrong position. To handle such a situation, the storage unit 150 may learn patterns associated with wrong wearing of the knee belt unit 120, and a warning may be given to the user each time the knee belt unit 120 is worn, which makes it possible to properly provide an assist from the beginning.

1.4.2 Second Modification

In the embodiment described above, it is assumed by way of example that the looseness of the knee belt unit 120 worn on a user is judged basically when the user is in a standing position. However, the judgement may be performed when a user is in a sitting position. For example, in a case where the assist system 200 is worn on an old user, the user is likely to wear the assist system 200 after the user sits in a chair. Therefore, in this case, when the looseness or the wearing position shift of the knee belt unit 120 is judged immediately after assist system 200 is worn, it is necessary to make the judgement in a state in which the user sits in a chair.

Figure 24:
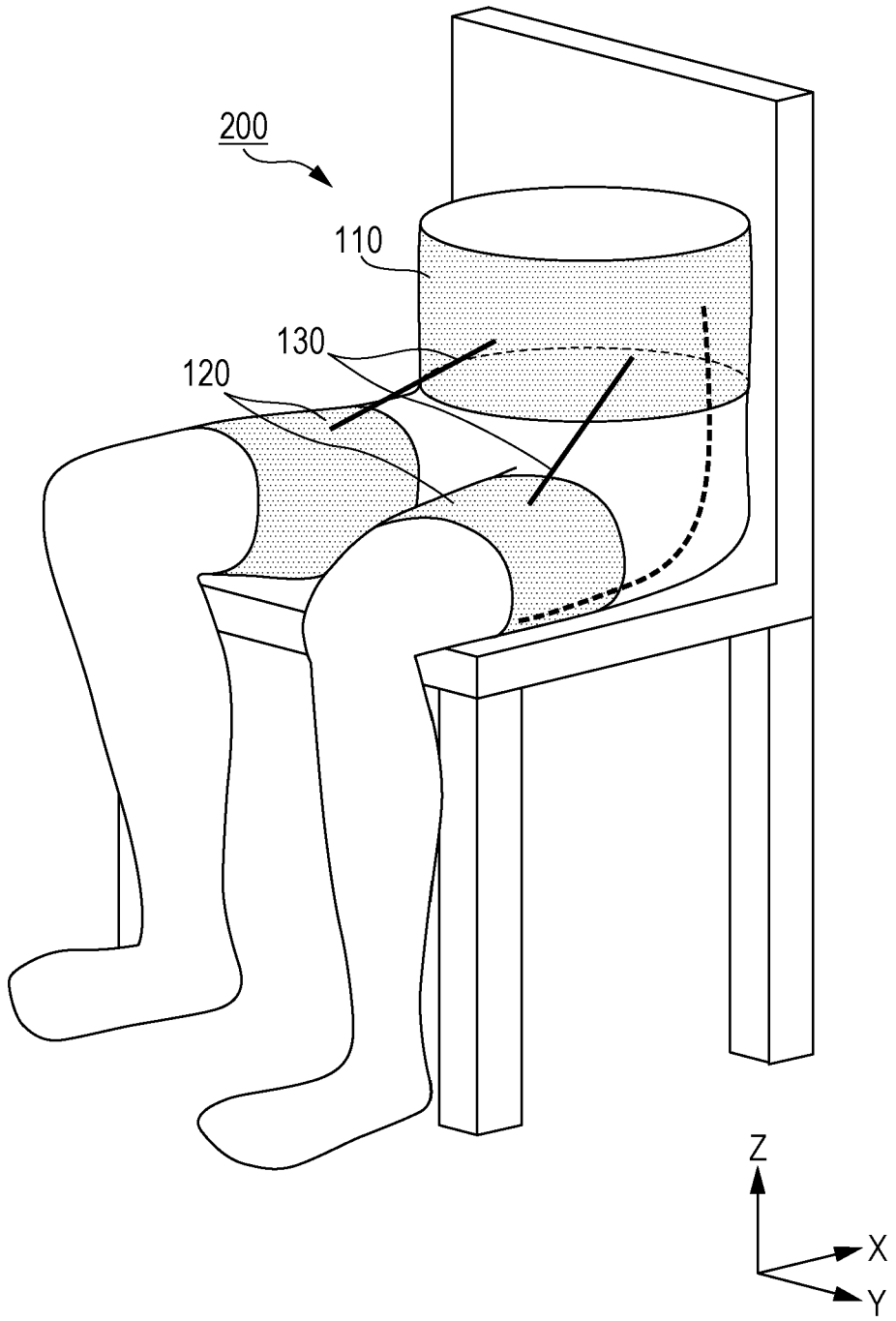
FIG. 24 is a diagram illustrating a manner in which a wearing state of a knee belt unit is judged for a user in a sitting state.

FIG. 24 is a diagram illustrating a manner in which the wearing state of the knee belt unit is judged for a user in a sitting position.

In the case of the standing position, the direction of the wire 130 is substantially the same as the gravitational direction, and thus if the wire 130 is pulled when the knee belt unit 120 is in a loose state, the knee belt unit 120 lifts upward once and then moves downward by the gravitational force. In this case, rotational movements about the Y-axis direction and the Z-axis direction may also occur. From values associated with these movements, the judgment unit 102 judges whether the knee belt unit 120 is in a loose state or whether the knee belt unit 120 is in a shifted state.

However, in the case of the sitting position, as shown in FIG. 24, the direction of pulling the wire 130 is different from the gravitational direction, and thus when the knee belt unit 120 is pulled by the wire 130, the knee belt unit 120 is unlikely to move back to its original position where it is located before it is pulled.

In FIG. 24, the X-axis direction is defined in a forward-backward direction of a user, the Y-axis direction is defined in a right-left direction of the user, and the Z-axis direction is defined in an upward-downward direction of the user. In the sitting position, as shown in FIG. 24, lower parts of legs (thighs) of the user are in contact with a chair. Therefore, when the wires 130 located on the lower parts of the user are pulled, frictional force causes the knee belt units 120 to hardly move regardless of whether the knee belt unit 120 is in a loose state. On the other hand, the wire 130 disposed on the front side of each leg of the user is not in contact with the chair. Therefore, when the wire 130 on this side is pulled, the knee belt unit 120 can move if the knee belt unit 120 is in a loose state. However, because the gravitational direction is different from the longitudinal direction of the wire 130, the knee belt unit 120 does not easily move back to its original position. Furthermore, in the sitting position, as shown in FIG. 24, when the wire 130 is pulled, the knee belt unit 120 is not pulled in a direction along the thigh but diagonally pulled in a direction toward the upper-body belt unit 110.

Therefore, in the case of the sitting position, the judgment unit 102 may integrate the acceleration in the X-axis direction and the angular velocity about the Y-axis direction provided from the movement measurement unit 121 and may calculate the displacement in the X-axis direction and the displacement about the Y-axis direction. If these values are greater than or equal to respective threshold values, and more specifically, for example, if the displacement in the X-axis direction is greater than or equal to a threshold value set to 2 cm to 10 cm or the displacement about the Y-axis direction is greater than or equal to a threshold value set to 0.05 to 0.5 rad, then the judgment unit 102 may determine that there is a looseness.

The determination as to whether a user is in the sitting position or the standing position may be performed based on a value output from the acceleration sensor disposed in the movement measurement unit 121. More specifically, for example, when a gravitational component is greater than or equal to 70% of the total value in the X-axis direction measured by the acceleration sensor, it may be determined that the user is in the standing position. On the other hand, if the gravitational component is greater than or equal to 70% of the total value in the Z-axis direction, it may be determined that the user is in the sitting position.

1.4.3 Third Modification

In the embodiments described above, the presentation unit 140 determines whether the knee belt unit 120 has a looseness or a wearing position shift, and presents information to a user by vibrating the knee belt unit 120 or by other methods to inform of the fact that the knee belt unit 120 has the looseness or the shift. However, what is presented is not limited to the example described above. For example, the presentation unit 140 may automatically fasten the knee belt unit 120 depending on the looseness so as to eliminate the looseness, or may rotate the knee belt unit 120 such that the wearing position shift is adjusted to its correct position. In this case, the presentation unit 140 may adjust the fastening degree of the knee belt unit 120 depending on the looseness degree measured by the movement measurement unit 121. That is, the assist system 200 may fasten the knee belt unit 120 such that the knee belt unit 120 is not shifted and such that a user does not feel a pain due to too strong fastening.

1.4.4 Fourth Modification

In the embodiments described above, it is assumed by way of example that the determination as to whether the calibration is started is performed by the movement measurement unit 121. However, the unit that performs the determination is not limited to the movement measurement unit 121. For example, the judgment unit 102 of the controller 100 may perform the determination. In this case, the judgment unit 102 may receive in real time the acceleration and the angular velocity of each knee belt unit 120 from the movement measurement unit 121, and may perform the determination based on the received acceleration and angular velocity as to whether the calibration is to be started. More specifically, for example, the judgment unit 102 may further determine whether the acceleration measured by the acceleration sensor 122 disposed on the knee belt unit 120 is smaller than or equal to the second threshold value. In a case where the acceleration measured by the acceleration sensor 122 is smaller than or equal to the second threshold value and the angular velocity measured by the gyrosensor 123 is greater than or equal to the first threshold value, the judgment unit 102 may output information indicating that the knee belt unit 120 is in a loose state or the knee belt unit 120 is in a shifted state.

This makes it possible for the judgment unit 102 to output information such that when a user is in a no-movement state, the information is output to notify the user that the knee belt unit 120 is in a loose state or the knee belt unit 120 is in a shifted state, which makes it possible to more effectively present to the user the information indicating the state. That is, when the user is in a no-movement state, the vibration actuator functioning as the presentation unit 140 may be vibrated to notify the user that the knee belt unit 120 is in a loose state or the knee belt unit 120 is in a shifted state more effectively than in the case where the notification is given when the user is in a moving state.

In a case where the acceleration measured by the acceleration sensor 122 is smaller than or equal to the second threshold value, the judgment unit 102 may output, to the drive controller 111, information indicating that the acceleration measured by the acceleration sensor 122 is smaller than or equal to the second threshold value.

1.4.5 Fifth Modification

In the embodiments described above, it is assumed by way of example that the upper-body belt unit 110 and the knee belt units 120 are formed separately. However, the manner of implementing the upper-body belt unit 110 and the knee belt units 120 is not limited to this example. For example, the upper-body belt unit 110 and the knee belt units 120 may be connected together into the form of pants (shorts).

1.5 Other Embodiments

In each embodiment described above, each constituent element may be realized using dedicated hardware or may be realized by executing software program corresponding to the constituent element. Each constituent element may be realized by a program execution unit such as a CPU, a process or the like by reading software program stored in a storage medium such a hard disk, a semiconductor memory, or the like and executing the software program. The software that realizes the assist method according to one or more embodiments may be a program described below.

That is, the program causes a computer to execute an assist method in an assist system including a first belt worn on an upper body of a user, a second belt worn on a knee of the user, a wire via which the first belt and the second belt are connected, and a motor coupled with the wire, the method including (a) applying a first tension to the wire by using the motor, (b) measuring, using a gyrosensor, an angular velocity in a direction perpendicular to a longitudinal direction of the wire when the first tension is applied, (c) in a case angular velocity is greater than or equal to a first threshold value, outputting information indicating that the second belt is in a loose state or the second belt is in a shifted state.

In the present disclosure, all or part of units, devices, and all or part of functional blocks illustrated in FIG. 2 or FIG. 23 may be implemented by one or more electronic circuits including a semiconductor device, a semiconductor integrated circuit (IC), an LSI (Large Scale Integration). The LSI or the IC may be integrated on a single chip or may be realized by a combination of a plurality of chips. For example, functional blocks other than storage elements may be integrated on a signal chip. The integrated circuits called the LSI or the IC herein may be called differently depending on the integration density, and integrated circuits called a system LSI, a VLSI (Very Large Scale Integration), or a ULSI (Ultra Large Scale Integration) may also be used in the present disclosure. Furthermore, a field programmable gate array (FPGA) capable of being programmed after the LSI is produced, and a reconfigurable logic device capable of being reconfigured in terms of internal connections or capable of being set up in terms of internal circuits blocks may also be used for the same purpose.

Part or all of functions or operations of units, apparatuses, part of an apparatus may be realized by software. In this case, the software may be stored in a non-transitory storage medium. The non-transitory storage medium may be one of or a combination of a ROM, an optical disk, a hard disk drive, or the like. A particular function is realized by executing the software by the processor in cooperation with a peripheral device. The system or the apparatus may include one or more non-transitory storage media in which software is stored, a processor, and a hardware device such as an interface.

The present disclosure has been described above with reference to, by way of example, the assist system and the assist method according to embodiments. However, the present disclosure is not limited to the embodiments described above. It will be apparent to those skilled in the art that many various modifications may be applicable to the embodiments without departing from the spirit and scope of the present disclosure. Furthermore, constituent elements of different embodiments may be combined. In this case, any resultant combination also falls within the scope of the present disclosure.

The technique according to the present disclosure is useful in an assist system that assists, using a wire, a movement of a person and more particularly in an assist system capable of effectively detecting a looseness or the like of a belt in the assist system.

What is claimed is:

1. An assist system comprising:

a first belt to be worn on an upper body of a user;

a second belt to be worn on a knee of the user;

a wire having a first end and a second end;

a motor coupled with the first end, the motor being disposed on the first belt or the second belt, the second end being coupled with the second belt when the motor is disposed on the first belt, the second end being coupled with the first belt when the motor is disposed on the second belt;

a drive controller that controls driving of the motor and generates an input pattern to apply a first tension to the wire to determine a fit of the second belt;

a gyro sensor that is disposed on the second belt and that measures a magnitude of an angular velocity of movement of the second belt about a direction perpendicular to a longitudinal direction of the wire; and a controller that outputs first information to the user as a notification when a first condition is satisfied, the first condition being that the magnitude of the angular velocity is greater than or equal to a first threshold value when the first tension is applied to the wire by using the motor, wherein the notification is provided as a text, an image, or a vibration to the user, the first information indicates that the second belt is worn on the knee loosely based on the angular velocity of the movement of the second belt in response to the first tension applied to the wire, and the first threshold value is larger than a magnitude of an angular velocity of movement of the second belt worn on the knee tightly about the direction perpendicular to the longitudinal direction of the wire in response to a second tension applied to the wire, a value of the second tension being the same as a value of the first tension.

2. The assist system according to claim 1, wherein the first information indicates that the second belt is in a shifted state.

3. The assist system according to claim 1, further comprising an acceleration sensor, wherein the first condition further includes a condition that an acceleration measured by the acceleration sensor is smaller than or equal to a second threshold value.

4. The assist system according to claim 1, further comprising an acceleration sensor, wherein when the acceleration measured by the acceleration sensor is smaller than or equal to a second threshold value, the drive controller controls the motor to apply the first tension to the wire.

5. The assist system according to claim 1, wherein the direction perpendicular to the longitudinal direction of the wire is a direction that is a forward-backward direction as seen from the user and is perpendicular to the longitudinal direction of the wire, and the first information indicates that the second belt is in a shifted state.

6. The assist system according to claim 1, further comprising a user interface that accepts setting by a user; and a storage unit that stores the setting accepted by the user interface;

wherein the controller adjusts the first threshold value depending on the setting stored in the storage unit and outputs, as the information, a result of judgement performed using the adjusted first threshold value.

7. The assist system according to claim 1, the gyro sensor is not disposed on the wire.

8. An assist method, in an assist system including a first belt to be worn on an upper body of a user, a second belt to be worn on a knee of the user, a wire having a first end and a second end, and a motor coupled with the first end, comprising:

(a) generating an input pattern to apply a first tension to the wire by using the motor, to determine a fit of the second belt;

(b) measuring a magnitude of an angular velocity of movement of the second belt about a direction perpendicular to a longitudinal direction of the wire when the first tension is applied, the measuring being performed using a gyrosensor disposed on the second belt; and (c) outputting first information to the user as a notification when a first condition is satisfied;

the first condition including a condition that the magnitude of the angular velocity is greater than or equal to a first threshold value, the first information indicating that the second belt is in a loose state or that the second belt is in a shifted state, the second end being coupled with the second belt when the motor is disposed on the first belt, the second end being coupled with the first belt when the motor is disposed on the second belt, and the notification being provided as a text, an image, or a vibration to the user, the first information indicates that the second belt is worn on the knee loosely based on the angular velocity of the movement of the second belt in response to the first tension applied to the wire, and the first threshold value is larger than a magnitude of an angular velocity of movement of the second belt worn on the knee tightly about the direction perpendicular to the longitudinal direction of the wire in response to a second tension applied to the wire, a value of the second tension being the same as a value of the first tension.

9. The assist method according to claim 8, further comprising (d) measuring an acceleration of the user using an acceleration sensor, wherein the first condition further includes a condition that the acceleration measured by the acceleration sensor is smaller than or equal to a second threshold value.

10. The assist method according to claim 8, further comprising:

(d) measuring an acceleration of the user using an acceleration sensor, and applying the first tension to the wire using the motor when where in (a), the acceleration measured by the acceleration sensor is smaller than or equal to a second threshold value.

11. The assist method according to claim 8, the gyro sensor is not disposed on the wire.

12. A storage medium including a stored control program for causing a device having a processor to execute a process, the storage medium being non-transitory and computer-readable, the process being for an assist system including a first belt to be worn on an upper body of a user, a second belt to be worn on a knee of the user, a wire having a first end and a second end, and a motor coupled with the first end, the second end being coupled with the second belt when the motor is disposed on the first belt, the second end being coupled with the first belt when the motor is disposed on the second belt, the process comprising:

(a) generating an input pattern to apply a first tension to the wire by using the motor, to determine a fit of the second belt;

(b) measuring a magnitude of an angular velocity of movement of the second belt about a direction perpendicular to a longitudinal direction of the wire when the first tension is applied, the measuring being performed using a gyrosensor disposed on the second belt; and (c) outputting first information to the user as a notification when a first condition is satisfied, wherein the first condition including a condition that the magnitude of the angular velocity is greater than or equal to a first threshold value, the first information indicating that the second belt is in a loose state or that the second belt is in a shifted state, and the notification being provided as a text, an image or a vibration to the user, the first information indicates that the second belt is worn on the knee loosely based on the angular velocity of the movement of the second belt in response to the first tension applied to the wire, and the first threshold value is larger than a magnitude of an angular velocity of movement of the second belt worn on the knee tightly about the direction perpendicular to the longitudinal direction of the wire in response to a second tension applied to the wire, a value of the second tension being the same as a value of the first tension.

13. The storage medium according to claim 12, wherein the process further comprises (d) measuring an acceleration of the user using an acceleration sensor, wherein the first condition may further include a condition that an acceleration measured by the acceleration sensor is smaller than or equal to a second threshold value.

14. The storage medium according to claim 12, wherein the process further comprises (d) measuring an acceleration of the user using an acceleration sensor, and applying the first tension to the wire using the motor when in (a), the acceleration measured by the acceleration sensor is smaller than or equal to a second threshold value.

15. The storage medium according to claim 12, the gyro sensor is not disposed on the wire.

* * * * *